US012392145B2

(12) United States Patent
Neubauer

(10) Patent No.: US 12,392,145 B2
(45) Date of Patent: Aug. 19, 2025

(54) STABILIZATION AND ANTI-ROTATION APPARATUS FOR SCAFFOLDING SYSTEM

(71) Applicant: Blue Moon Designs, LLC, Bend, OR (US)

(72) Inventor: Dale Martin Neubauer, Bend, OR (US)

(73) Assignee: Blue Moon Designs, LLC, Bend, OR (US)

( * ) Notice: Subject to any disclaimer, the term of this patent is extended or adjusted under 35 U.S.C. 154(b) by 1066 days.

(21) Appl. No.: 17/379,560

(22) Filed: Jul. 19, 2021

(65) Prior Publication Data

US 2021/0348399 A1 Nov. 11, 2021

Related U.S. Application Data

(63) Continuation-in-part of application No. 16/278,113, filed on Feb. 17, 2019, now Pat. No. 11,187,000, which is a continuation-in-part of application No. 15/435,342, filed on Feb. 17, 2017, now Pat. No. 10,246,939.

(60) Provisional application No. 62/297,247, filed on Feb. 19, 2016.

(51) Int. Cl.
*E04G 1/30* (2006.01)
*E04G 1/24* (2006.01)

(52) U.S. Cl.
CPC ..... *E04G 1/30* (2013.01); *E04G 1/24* (2013.01); *E04G 2001/246* (2013.01); *E04G 2001/307* (2013.01)

(58) Field of Classification Search
CPC .... E04G 1/15; E04G 1/30; E04G 7/28; E04G 2001/302; E04G 2001/307; E04G 1/14; E04G 2001/158; E06C 1/39; B25H 1/06
See application file for complete search history.

(56) References Cited

U.S. PATENT DOCUMENTS

| | | | |
|---|---|---|---|
| 311,272 | A | 1/1885 | Tibbals |
| 353,868 | A | 12/1886 | Koerner |
| 550,175 | A | 11/1895 | Holden |
| 572,201 | A | 12/1896 | Hausmann |
| 662,566 | A | 11/1900 | Jones |
| 986,953 | A | 3/1911 | Soule |
| 1,423,725 | A | 7/1922 | Mohr et al. |

(Continued)

FOREIGN PATENT DOCUMENTS

| | | | |
|---|---|---|---|
| DE | 9412300 | U1 | 9/1994 |
| FR | 2970027 | B1 | 7/2015 |

*Primary Examiner* — Colleen M Chavchavadze
(74) *Attorney, Agent, or Firm* — Leber IP Law; Celia H. Leber

(57) ABSTRACT

A stabilization and anti-rotation system provides for secure interconnection between a scaffolding work platform and two primary platforms, each of which is attached to a ladder, and prevents relative movement between the primary platforms and the scaffolding platform. A locating block is attached to a plate of each primary platform 402. A pair of spaced apart and vertically oriented guide blocks are attached to a facing plate on each end of the work platform and positioned so that a guide slot is defined between the blocks. When assembled, the locating block is closely captured between the guide blocks and the structure provides stability and prevents rotation of the work platform relative to the primary platforms.

13 Claims, 36 Drawing Sheets

(56) References Cited

U.S. PATENT DOCUMENTS 1,520,414 A 12/1924 Hamilton
2,024,039 A 12/1935 Harting
2,172,860 A 9/1939 Weaver
2,377,211 A * 5/1945 Cocken, Jr. ..... E04F 15/06 52/578
2,578,119 A 12/1951 Yench
2,666,608 A 1/1954 Holm
2,694,609 A * 11/1954 Trafford ..... A47B 1/00 108/64
2,887,260 A 5/1959 McKinnie
3,491,852 A 1/1970 Leist
3,500,606 A * 3/1970 Wharmby ..... E04F 15/10 52/591.1
3,698,511 A * 10/1972 Dohan ..... E04G 1/14 182/119
3,703,939 A 11/1972 Maxwell
3,768,592 A 10/1973 Higgins
3,954,155 A 5/1976 Guidara
4,004,652 A * 1/1977 Laboy-Alvarado ..... E04G 1/34 182/1
4,483,415 A 11/1984 Disston et al.
4,494,626 A 1/1985 Ast
4,569,419 A 2/1986 Stoltz
4,759,162 A * 7/1988 Wyse ..... E04H 3/24 52/126.6
5,551,529 A 9/1996 Molitor
6,085,867 A * 7/2000 Daniel, III ..... E04F 11/112 182/115
6,141,829 A 11/2000 Boyer
8,485,316 B2 7/2013 Vestal et al.
8,584,598 B2 * 11/2013 Derkoski ..... A47B 3/12 108/14
8,602,162 B2 12/2013 Dondurur et al.
8,701,831 B2 4/2014 Moss et al.
D722,181 S 2/2015 Green
9,038,775 B2 5/2015 Durkin
9,038,776 B2 5/2015 Green et al.
10,626,622 B2 * 4/2020 Huang ..... E04F 15/02
10,640,983 B2 * 5/2020 Honeycutt ..... E04G 27/00
2004/0003966 A1 1/2004 Yeoman
2010/0282540 A1 11/2010 Moss et al.
2011/0198153 A1 * 8/2011 Dufour ..... E04G 27/00 182/113
2015/0320201 A1 * 11/2015 Meadows ..... A47B 3/08 29/428
2016/0024844 A1 1/2016 Neubauer
2017/0173778 A1 * 6/2017 Reinhart ..... B25H 1/02
2020/0063491 A1 2/2020 Green

* cited by examiner

STABILIZATION AND ANTI-ROTATION APPARATUS FOR SCAFFOLDING SYSTEM

FIELD OF THE INVENTION

The present inventions are generally directed to light-weight moveable safety ladders and work platforms and more specifically to ladders and platforms that can be placed in close proximity to helicopters, aircraft and other vehicles or equipment in order to provide human workers with a safe and stable means of accessing, inspecting or servicing those and similar machines. More specifically, the inventions are defined by cantilevered ladders that are paired with scaffolding work platforms that attach to and extend between ladders, and an apparatus to stabilize and prevent rotation of the scaffolding work platforms relative to the ladders.

BACKGROUND INFORMATION

Aircraft, and most especially helicopters, require regular inspection and maintenance by trained mechanics. In order to gain close access to surfaces, parts or areas higher than can be reached while standing upon the ground, it is necessary to use a ladder or work platform of adequate height.

When work must be performed in the field, on the flight-line or elsewhere where no dedicated stationary platform is available, the mechanic will use a portable platform or ladder. Most frequently a conventional hinged aluminum folding-ladder is used. Such ladders are light in weight, can be carried by a single person and placed adjacent to the helicopter as required. Such ladders, however, are not stable. They can be hazardous when used correctly and dangerous when used incorrectly or when a mechanic is struggling to lift a heavy part or tool.

Furthermore, a conventional folding ladder cannot be positioned relative to the curved body of a helicopter in a manner so that the mechanic is positioned in close proximity to the aircraft. Whether placed parallel to or at an angle to the body of a helicopter, the poor fit of the ladder to the aircraft compromises the ability of the mechanic to perform his work and creates a hazardous condition when he is forced into awkward or unstable positions.

Lightweight, portable ladders or platforms that are truly safe, stable and which may be positioned so as to provide the kind of uncompromised access a mechanic requires are not known in the art. One product that is on the market is called the Aircraft MRO Pylon Ladder manufactured by Lock-N-Climb LLC (http://lockclimb.com/pylon-ladder/). This is a light-weight cantilevered aluminum stepladder that may be used for aircraft maintenance, but which fails to provide a truly safe and stable platform. This ladder is a conventional stepladder to which shortened support rails have been attached at about the mid-point of the stepped rails. To partially compensate for the shortness of the support rails, angled extensions have been affixed to the top end of those rails. It is apparent that the support legs will not fold flat against the stepped legs, thus making the ladder excessively bulky when in its folded position. The support legs are, of necessity, braced and cross-braced such that they cannot straddle the cross-tubes of a helicopter's skid assembly and would be unusable in many applications. Furthermore, because the support legs of the Pylon Ladder do not extend beyond the bottom of the stepped legs when the ladder is in the folded position and do not make a more acute angle to the ground than do the stepped legs when the ladder is in its open, operational, position, the Pylon Ladder would be expected to provide less than optimal resistance to forward tipping.

Folding step ladders are required by regulatory standards to have a locking mechanism on each side of the ladder that will prevent the spreader arms from articulating when the ladder is in use. More specifically, the purpose of this locking mechanism is to ensure that the ladder does not fold up when a worker is standing on the ladder rungs. The most conventional form of a locking mechanism is defined by the well-known braces that extend between the stepped side of the ladder and the support side of the ladder. The braces typically have a first elongate arm that is pivotally attached to a rail of the stepped unit, a second elongate arm that is pivotally attached to the support unit, and one-way locking hinge mechanism interconnecting the two elongate arms. In use, as the support unit is articulated away from the stepped unit to move the ladder to its open position, the braces are locked by pushing down on the one-way hinge mechanism. Doing so causes the spreader arms to align end-to-end or causes them to move into a slightly over-centered configuration. While no actual locking occurs at the brace mechanism, there is a frictional jamming that occurs and which is sufficient to ensure that the ladder will not collapse when stood upon.

The conventional spreader arm locks just described generally meet regulatory safety requirements and prevent an open ladder from closing when stood upon. These locks, however, do not engage automatically, and they require that the user push down the lock to fully engage the locking hinge mechanism when the ladder is opened. Failure to perform this action negates this safety feature and the ladder can accidentally collapse when in use. Moreover, the spreader arms may be inadvertently moved away from the locked position when the ladder is jostled and jarred as it is moved from one position to another. This has the potential of causing a dangerous condition where the spreader arms collapse when a user climbs the steps.

Additionally, most folding ladders have a fixed length. There are many known types of extension ladders, and there are known examples of folding or step ladders that have the ability to be extended. For example, some manufacturers have combined the structures of conventional extension ladders with folding step ladder design. But since many ladder users require ladders of varying lengths (as evidenced by the popularity of conventional extension ladders), there is a need for folding ladders that are able to be of multiple lengths and which are safe for the users.

SUMMARY OF THE INVENTION

It is an object of the invention to devise a portable ladder that can be manipulated by one person and be placed in close proximity to a helicopter, an aircraft or to another piece of equipment.

It is an object of the invention to devise a portable ladder than can closely nest with the curved body of a helicopter, aircraft or equipment and by so doing, provide ready access to a variety of surfaces and areas.

It is an object of the invention to have the ability to clear, straddle or otherwise avoid interference with portions of the aircraft or other equipment to which the ladder is being placed adjacent.

It is an object of the invention to provide enhanced access to the upper portions of otherwise difficult to access parts, such as to the rotor assembly of a helicopter.

It is an object of the invention to provide enhanced stability in comparison to conventional step ladders.

It is an object of the invention to provide stepped rungs upon which a person can stand that are cantilevered with respect to the attachment point of the supporting legs.

The ladder described in this invention has two pairs of legs (commonly known as "rails"). Typically, one pair of rails is longer than the other. The longer pair is interconnected with rungs or steps and designed to be stood upon. The shorter pair of rails is interconnected with bracing and designed to provide stability. The longer pair of rails when connected with steps or rungs is hereafter referred to as the 'stepped unit'. The shorter pair of rails when connected with bracing is hereafter referred to as the 'support unit'.

The two units are attached to each other at a hinge-point located some distance below the top of the stepped unit. The two units are further attached to each other by a brace which can retract when the ladder is in the folded position and can extend to hold the ladder in the open position.

When in the folded position, the two units are ostensibly parallel and in close proximity to one another. In the folded position, the lower portion of the support unit extends beyond the lowest portion of the stepped unit.

When unfolded and locked in place by the side braces, the two units are held at different angles with respect to the ground. The angle of the stepped unit is typical of a conventional folding ladder. The angle of the support unit is more acute.

The hinge point is typically located within about the middle third of the stepped unit. The upper portion of the stepped unit is thus cantilevered with respect to the hinge point. The ladder is constructed of materials sufficient to permit a person to stand one or more rungs above the hinge point.

When the ladder is placed at approximately right angles to the aircraft, the curved body of the aircraft fits within the space defined by the stepped and support units. By selecting appropriate rail lengths and an appropriate attachment point location, ladders can be tailored to fit specific aircraft profiles.

Another object of the present invention is to provide a mechanism that physically locks the spreader arms so that they are prevented from articulating inadvertently when the ladder is being stood upon.

Objects of the invention include locking the spreader arms so they are prevented from articulating when the ladder is tilted back toward the operator and the support rails are lifted into the air and to physically lock the stepped rails and the support rails at a fixed distance apart, a distance that will not increase when the operator stands upon the ladder.

Yet another object of one aspect of the invention is to provide a fully automatic mechanism for locking the spreader bars relative to one another.

In another aspect of the invention, an object is to provide an extension module that may be securely coupled to the ladder of the invention to effectively increase the working height of the ladder.

In yet another aspect of the invention, an object is to provide apparatus for stabilizing a work platform such as a scaffolding platform that is interconnected between two ladders according to the invention, and to prevent rotation of the work platform as loads are applied to the platform.

BRIEF DESCRIPTION OF THE DRAWINGS

The foregoing and other features of the invention will be apparent from the following, more particular descriptions of exemplary embodiments of the invention, as illustrated in the accompanying drawings. Like reference numbers indicate identical or functionally and/or structurally similar elements.

in FIG. 7 the ladder is shown in an intermediate position between the open, working position and the folded, storage position.

FIG. 13 is an upper perspective view of one embodiment of a ladder according to the invention, showing the ladder in the working position, wherein the ladder shown has an extension module of a first length secured in place.

FIG. 14 is an upper perspective view of another embodiment of a ladder according to the invention, showing the ladder in the working position, wherein the ladder shown has an extension module of a second length secured in place.

FIG. 15 is an upper perspective view of another embodiment of a ladder according to the invention, showing the ladder in the working position, wherein the ladder shown has an extension module of a third length secured in place.

FIG. 34 is an upper perspective view of a primary platform illustrated juxtaposed adjacent to a work platform, prior to connecting the two structures and illustrating the scaffolding stabilization and anti-rotation apparatus according to the present invention.

FIG. 35 is a lower perspective view of the primary platform and work platform shown in FIG. 34, taken from a different perspective, namely, approximately 180 degrees opposite of the view of FIG. 34.

FIG. 36 is an upper perspective view of a primary platform and a work platform interconnected.

FIG. 37 is a lower perspective view of the primary and work platforms shown in FIG. 36, taken from a different perspective, namely, approximately 180 degrees opposite of the view of FIG. 36.

FIG. 38 is a side elevation view of the plates that are attached to the primary platform and the work platform, with the views juxtaposed relative to one another to illustrate the structural elements that interact when the two platforms are interconnected to stabilize the scaffolding system and to prevent rotation of the work platform relative to the primary platforms.

DETAILED DESCRIPTION OF EMBODIMENTS OF THE INVENTION

Exemplary embodiments are discussed in detail below. While specific exemplary embodiments are discussed, it should be understood that this is done for illustration purposes only. Persons skilled in the relevant art may recognize that other components and configurations may be substituted without parting from the spirit and scope of the invention. It is to be understood that each specific element includes all equivalents that operate in a similar manner to accomplish a similar purpose.

Figure 1:
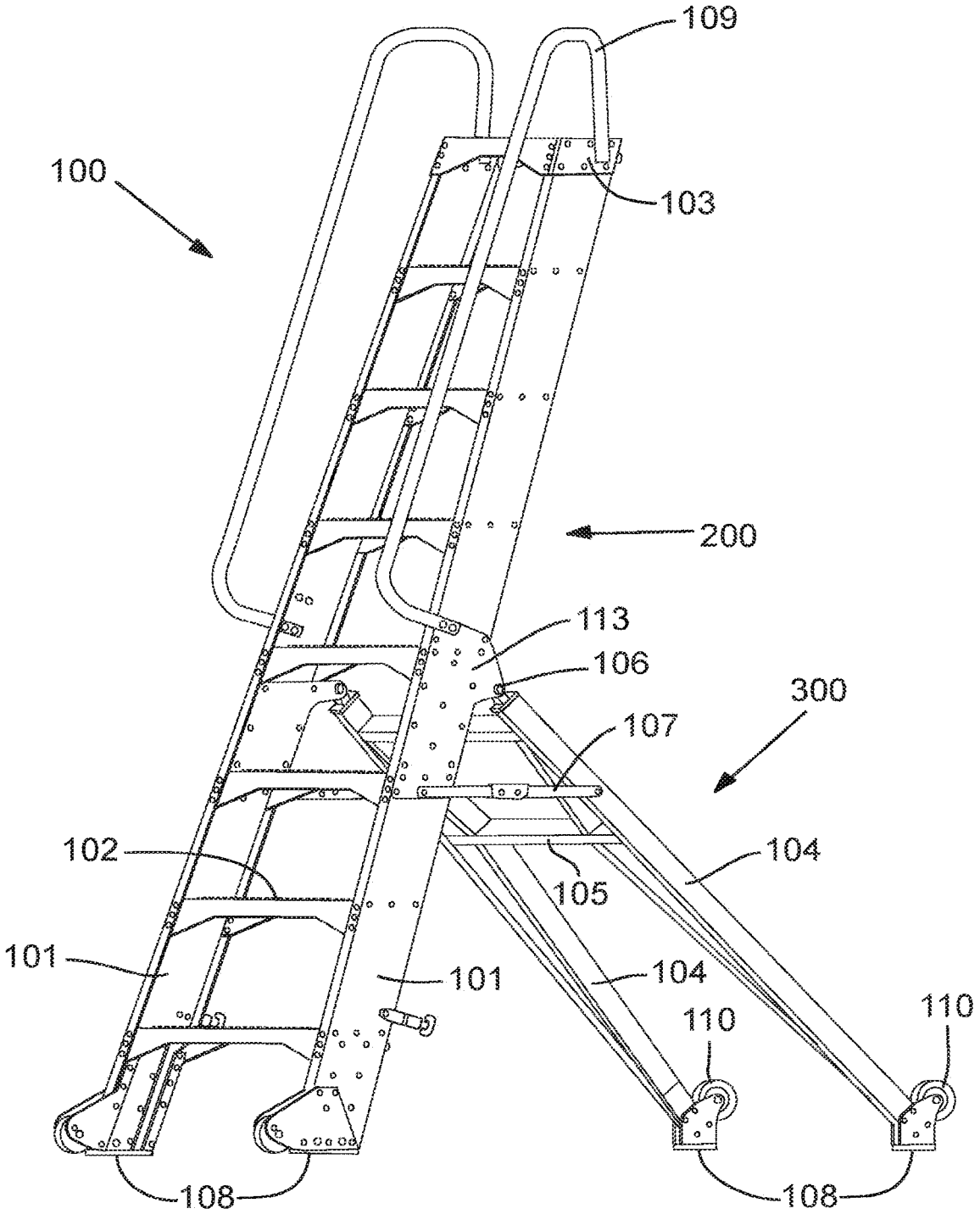
FIG. 1 is a perspective view of a first embodiment of the present invention in which the support unit is hinged to the stepped unit within about the middle third of the length of the stepped unit.

Referring now to FIG. 1, a lightweight, portable, safety ladder and work platform 100 according to the first embodiment of the present invention is shown. The ladder is comprised of two pairs of rails. To one pair of rails 101 steps 102 and a top plate 103 are attached. This combination of rails, steps and top plate will be referred to as the 'stepped unit' 200. The other pair of rails 104 are braced 105 to each other as can most clearly be seen in FIG. 3. The combination of braced rails will be referred to as the 'support unit' 300. The support unit is attached to the stepped unit with hinges 106 and foldable braces 107. The length of the support rails and the location of the hinge attachment point or points along the stepped unit are variables which can be optimized for use with specific aircraft and helicopters. The bottom ends of the stepped rails 101 and the support rails 104 are fitted with pads 108 that assist in preventing the ladder from slipping. Attached to the stepped unit is a pair of handrails 109. In this embodiment, the stepped rails are further apart where they touch the ground than where they are joined at the top plate. Similarly, the support rails are further apart where they touch the ground than where they are joined to the stepped unit at the two hinge points.

Figure 2:
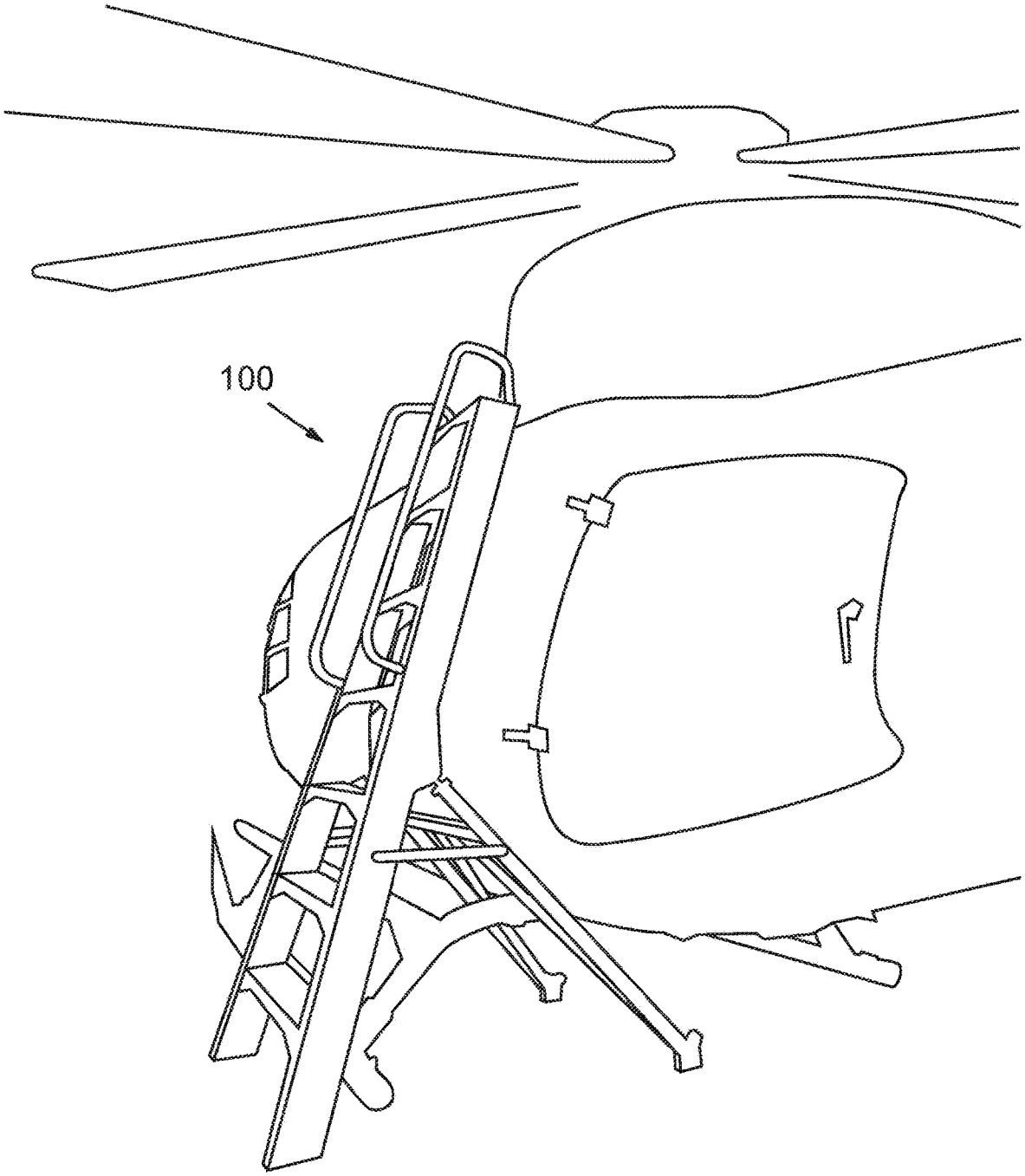
FIG. 2 illustrates an embodiment of the portable ladder according to an embodiment of the invention with the ladder nested in close proximity to a helicopter.

FIG. 2 illustrates an embodiment of the present invention in close proximity to an aircraft ready to be used for its intended purpose.

Figure 3:
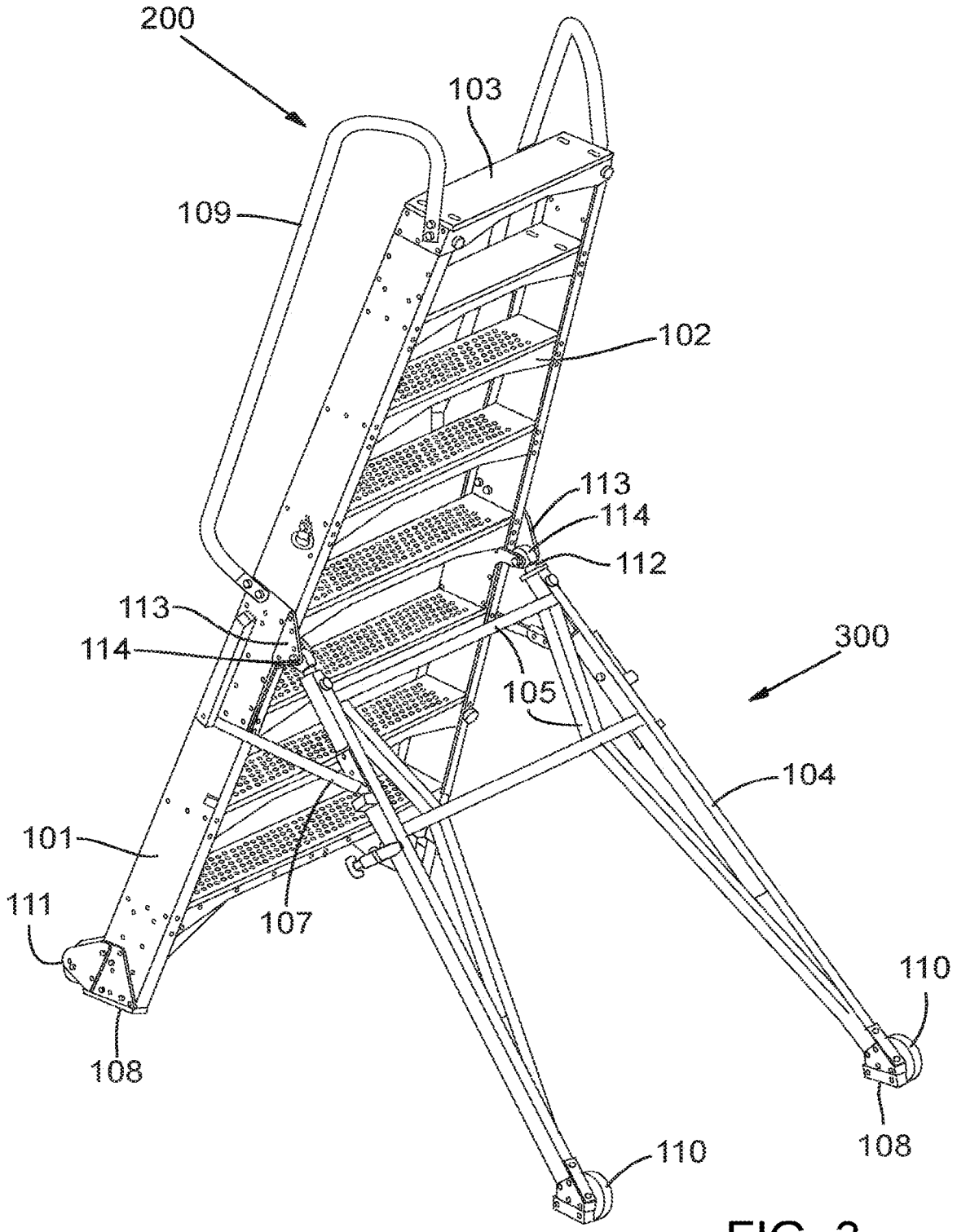
FIG. 3 is an isometric view of an embodiment of the support unit according to the invention braced such that it can straddle objects between the support rails.

FIG. 3 depicts an isometric view of an embodiment of the safety ladder such that the support unit 300 is clearly visible. The support rails 104 are shown with internal bracing 105 that rigidly holds the two members and provides the structural strength necessary to meet the load requirements of the ladder. The bracing is constructed so as to leave the space between the rails empty, thus permitting the unit to fit over obstacles such as the helicopter skid cross tubes seen in FIG. 2.

The ladder depicted in FIG. 3 is fitted with wheels 110 on upward facing edges of the support rails 104 and wheels 111 the backward facing edges of the stepped rails. Such wheels can be of assistance in transporting the ladder to the work area and in positioning the ladder in proximity to the aircraft.

The stepped unit 200 and support unit 300 are interconnected through the use of two rod end ball joints 112. These rod end ball joints are better seen in the enlarged view provided in FIG. 3*a*.

Figure 3A:
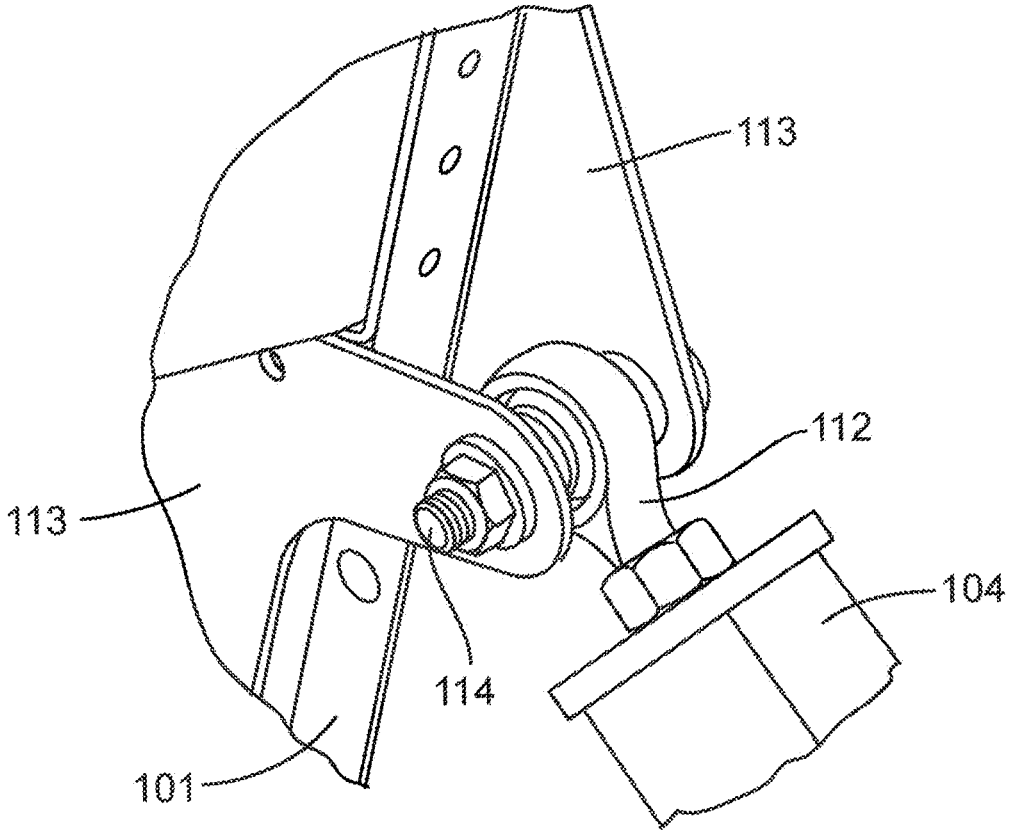
FIG. 3*a* is an enlarged perspective view of the rod end ball joint used as a hinge mechanism in the embodiment shown within FIG. 3.

In FIG. 3*a* the rod end ball joint 112 is securely attached to the top end of the support rail 104. Two brackets or plates 113 are securely attached to the stepped rail 101 in the area where the support unit and stepped unit will be joined. A securing bolt 114 passes through corresponding holes in those plates and through the eye of the rod end ball joint, thus completing the hinge assembly.

Figure 4:
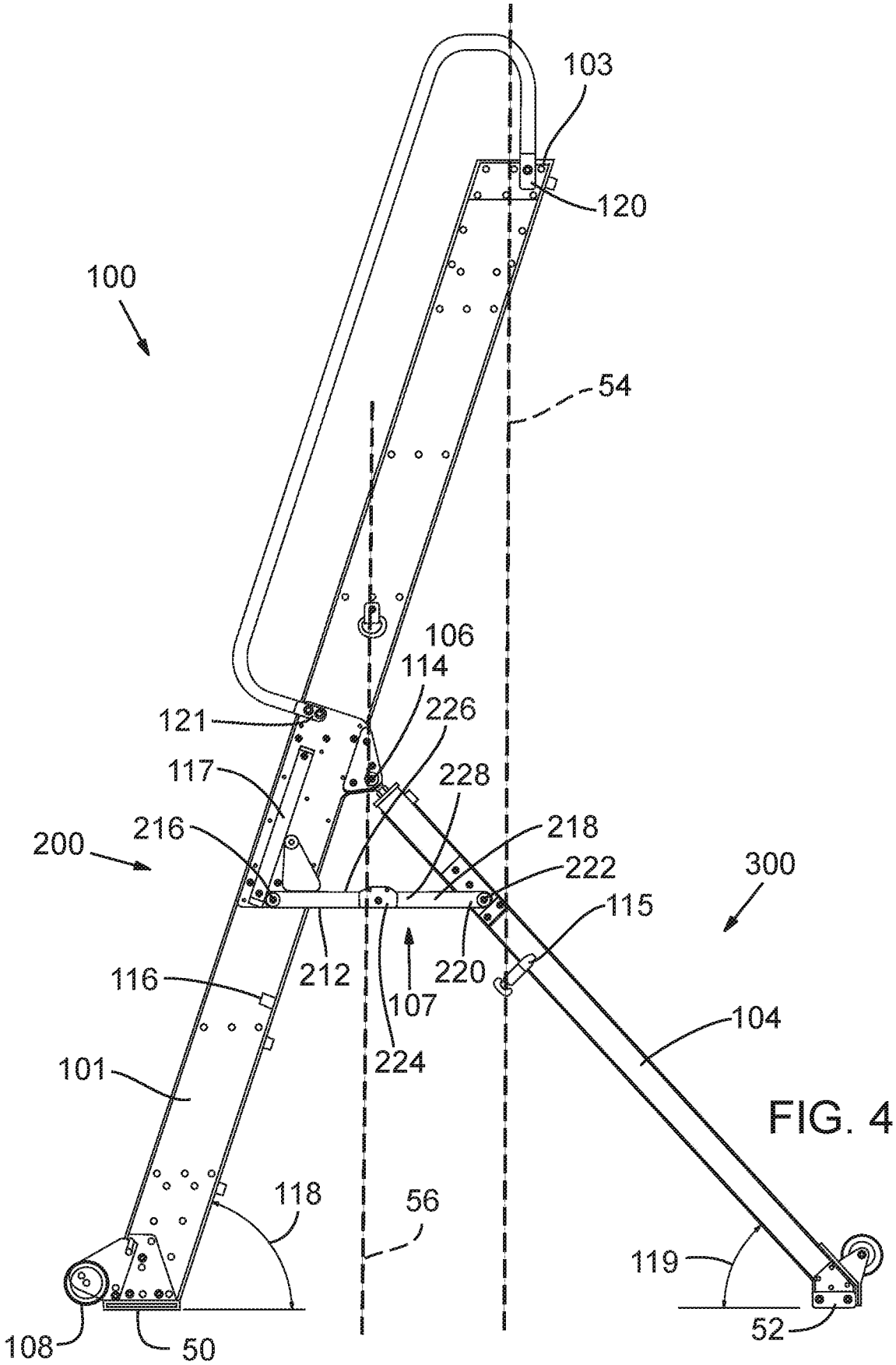
FIG. 4 is a side elevation view of an embodiment of a portable ladder according to the invention in an open position where the angle measured between the ground and the stepped unit is greater than the angle between the ground and the support unit.

FIG. 4 depicts a side view of an embodiment of the ladder in its open position. A latching strap 115 is secured to the stepped rail 104 and a corresponding latching hook 116 is secured to the support rail 101. When the ladder is in the closed position, the latching strap and latching hook may be joined to secure the stepped unit 200 to the support unit 300. A protective bumper 117 is affixed to the stepped rail. When the ladder is in the closed position and laid on the ground upon its side, the bumper acts to protect the folding side braces 107.

In FIG. 4, it can be seen that the angle measured between the ground and the stepped rail 118 is greater than the angle measured between the ground and the support rail 119. Moreover, in FIG. 4 it may be seen that when the ladder 100 is in the open, working position, the top plate 103 is located beyond the hinge axis that is defined by securing bolt 114 (see FIG. 3*a*; the securing bolt is also referred to as the "hinge axis 114"). In the side elevation view of FIG. 4 the foot of the stepped unit 200 is identified with reference number 50 and the foot of the support unit 300 is identified with reference number 52. If a triangle is defined by the lines interconnecting the hinge axis 114, foot 50 and foot 52, then the horizontal location of top plate 103 is to the right of hinge axis 114 and to the left of foot 52. Stated another way, when the ladder 100 is in the open position and located on a horizontal ground plane, then a vertical line drawn from the top plate 103 to the ground plane intersects the line extending from the foot 50 to the foot 52 at a position intermediate between the intersection of a line extending from hinge axis 114 to the line extending from the foot 50 to the foot 52. These two vertical lines are illustrated in phantom lines in FIG. 4, labelled with reference numbers 54 and 56, respectively. This geometric orientation is distinctive and important.

Figure 5:
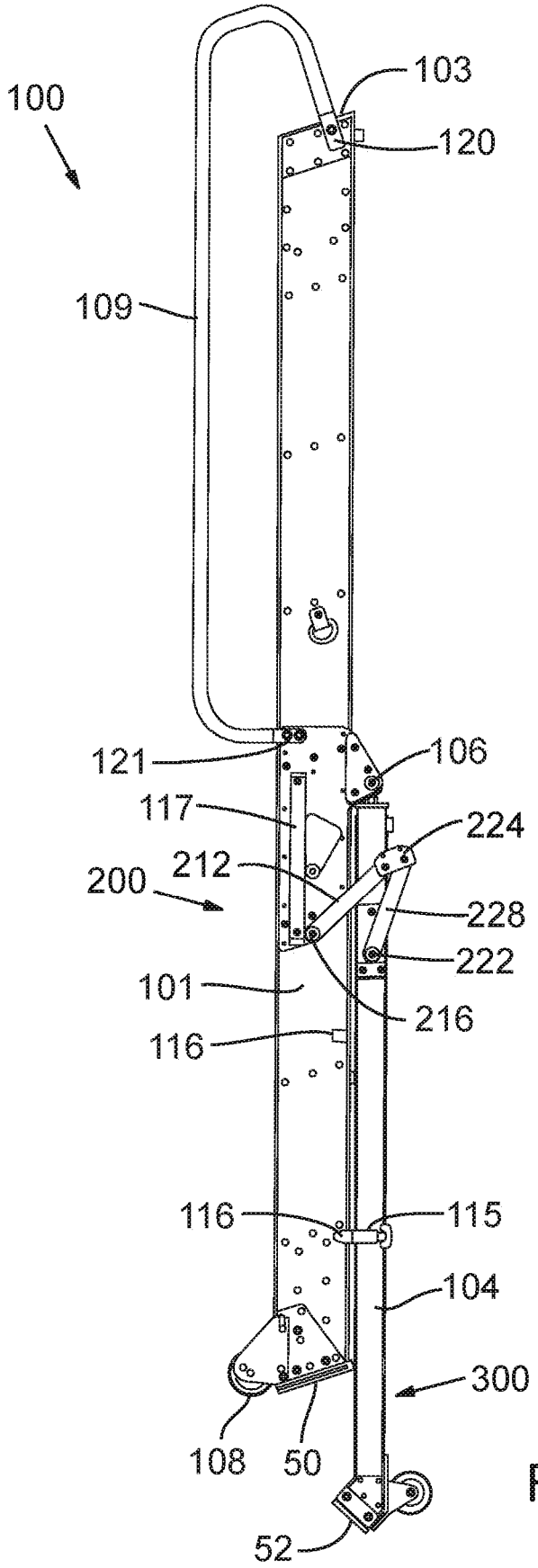
FIG. 5 is a side elevation view of an embodiment of a portable ladder in a folded position in which the support unit extends beyond the bottom of the rails of the stepped unit.

FIG. 5 depicts a side view of an embodiment of the ladder in its closed position. In this depiction, the latching strap 115 is secured to its corresponding latching hook 116 thus holding the stepped and support units together for ease of transport. In this closed and latched position, the support rails 101 are in a close and substantially parallel orientation with respect to the support rails 104, thus minimizing the space requirement for storing or transporting the ladder. The handrails 109 are secured to the stepped unit with removable bolts at attachment points 120 and 121. The handrails may be detached from the ladder by removal of the bolts, further minimizing the space requirement for storing or transporting the ladder.

In FIG. 5, it can be seen that the support legs 104 extend beyond the bottom of the stepped rails 101 and below the friction pads 108 secured to the end of those rails.

Materials, Design Considerations and Operation

Based upon the foregoing description of the elements, their configuration and interconnection, one skilled in the art would be expected to be able to construct a lightweight portable ladder that provided the advantages possessed by described embodiments of the present invention. Described here are additional details related to the material used, design considerations and operation of the ladder.

Because safety and stability are characteristics of paramount importance, design consideration can augment the suitability of the ladder for its intended purpose. In FIGS. 1, 2, 3 and 6 embodiments of the ladder are depicted with both the support rails 104 and the stepped rails 101 being spaced wider apart at their bottom end than at their top end.

With respect to the stepped rails 101 of the stepped unit 200, the wider stance at the friction pads 108 provides additional stability. The shortening of the steps 102 which occurs as one traverses up the ladder serves to centralize the mass and to provide additional stability through those means. The narrowed stance at the upper steps further serves to bring the handrails 109 into a more convenient position to be gripped by the person standing upon the ladder.

With respect to the support rails 104 of the support unit 300, the wider stance at the friction pads 108 provides additional stability which is further enhanced owing to the fact that the support rails 104 are longer than the stepped rails as measured from the hinge point 106. Because the angle of flare is ostensibly the same for the rails of both the support unit and the stepped unit, the added length of the support rails results in the friction pads 108 of the support unit being spread still further apart. These more widely spaced foot pads act as if they were outriggers and provide enhanced stability in the lateral direction.

With further respect to the support rails 104 of the support unit, it should be apparent to those skilled in the art that their extended length provides increased resistance to tipping forward, thus allowing the ladder to support heavier loads being applied higher above the hinge point 106. In order to accommodate these higher loads and forces, the support rails 104 and support rail bracing 105 must be constructed using appropriately strong materials. High tensile strength aluminum tubing has proven to be suitable for this purpose. Various other metals, alloys, fiberglass and composites might also prove suitable.

With further respect to the issue of safety and stability, in the embodiment depicted in FIGS. 1, 2 and 3 the rails 101 and steps 102 are oversized compared to those found in conventional stepladders. These larger steps better facilitate the safety ladder and work platform functions of the present invention giving the mechanic a stronger and larger platform upon which to stand. The presence of handrails 109 further add to the safety features of this ladder.

Persons skilled in the art understand that step ladders can be constructed using a variety of hinge mechanisms 106. Any number of hinged mechanisms that would permit the stepped unit to smoothly swing relative to the support unit could be used to construct a ladder that shared many of the advantages of the present invention. For example, a continuous hinge (commonly called a 'piano' hinge) could be used such that one flap is affixed to the backside of a step 102 and the other flap is affixed to bracing 105 connecting the top ends of the support rails 104. An obvious limitation of using this arrangement would be that that there are a discrete number of steps thus a limited number of structurally appropriate attachment points.

Because it is desirable to construct a helicopter maintenance ladder with optimized angles, it is important to be able to locate the hinge points wherever the design requires. It is further desirable for those hinges to operate smoothly without binding and with a minimum of free play which, if present, would permit the ladder to wiggle or shake. The limitation described for the embodiment using a continuous hinge can be overcome by using a pair of rod end ball joints 112 or functional equivalents such as spherical rod end ball joints, race linkage rod ends or rod end bearings. Such joints may be affixed to the top ends of the support rails 104 and corresponding attachment means affixed to the rails 101 of the stepped unit wherever the design requires. Alternately, attachment means may be affixed to the top end of the support rails 104 and corresponding rod end ball joints affixed to the rails 101 of the stepped unit. Such flexibility facilitates the construction of a ladder having angles optimized for its intended use. Another advantage of using paired rod end ball joints in this application is that paired joints permit ostensibly zero motion in any direction other than the desired axis of rotation. When used as the hinge element in the construction of embodiments of the present invention, rod end ball joints contribute greatly to the production of safety ladders that are exceptionally stable and secure.

With respect to moving the ladder from where it may be stored to where it will be employed, the ladder may be found to be light enough to be carried by one person. Alternatively, the ladder, preferably in its closed position as seen in FIG. 5, can be rolled to the work site using attached wheels 110 or 111. The safety hand rails 109 provide a convenient handle when pushing or pulling the ladder upon either pair of wheels.

In operation, the ladder is brought into its fully open position by pivoting the rails 101 and 104 upon the hinge mechanism 106 until the folding braces 107 are fully extended. Once extended, the folding braces lock the ladder into its operational position. Once so locked the ladder is moved into its ultimate work position either by manually lifting, or tilting and then rolling it upon wheels 111, or by dragging, or by rocking it upon the friction foot pads 108 and/or by combinations thereof. As most clearly seen in FIG. 2, in order to place the ladder in its optimal work position, it may be necessary to clear, straddle or otherwise avoid contact with various portions of the aircraft or helicopter. A properly constructed embodiment of the present invention will have taken into consideration the nature and location of those obstacles and will integrate well with the aircraft for which it was designed.

To further enhance the utility of the present invention as a work platform for the maintenance of aircraft, helicopters and other machinery, the ladder may be fitted with additional accessories such as trays, tool and part holders, cup holders and the like. These accessories may be permanently attached, hung from the ladder, or attached by temporary or removable means. In an embodiment of the current invention not shown in any of the figures, the ladder is fitted with receptacles sized to receive a quart-sized can of motor oil mounted on the outboard surfaces of each of the two stepped rails 101 near the top plate 103. These receptacles provide convenient repositories for the placement of small parts when the ladder is in use and further serve as protective bumpers when the ladder is laid upon either side.

Figure 6:
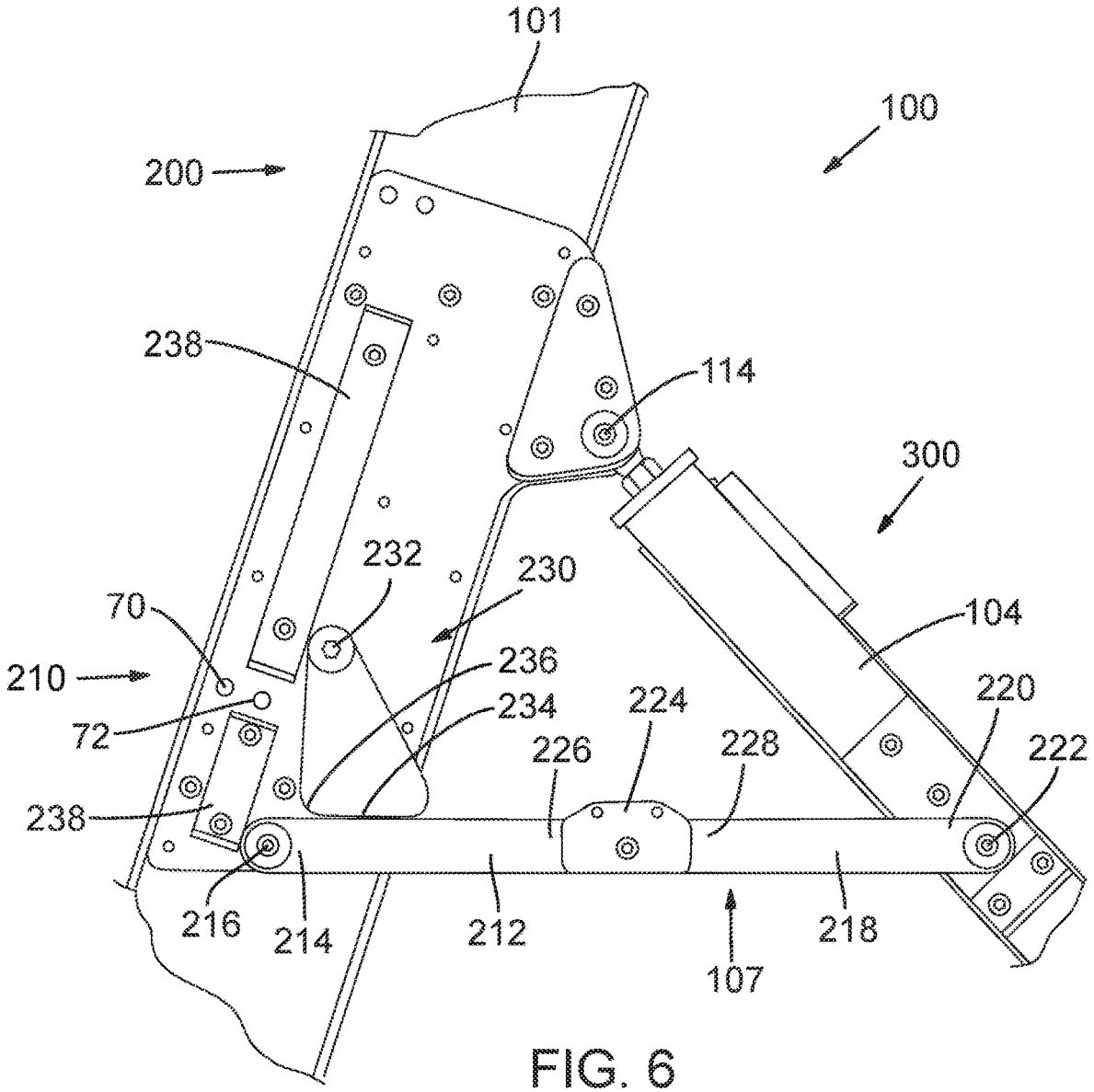
FIG. 6 is a close up side elevation view of a brace locking mechanism according to the present invention, illustrating the mechanism in the locked position when the ladder is in the open, working position.
Figure 7:
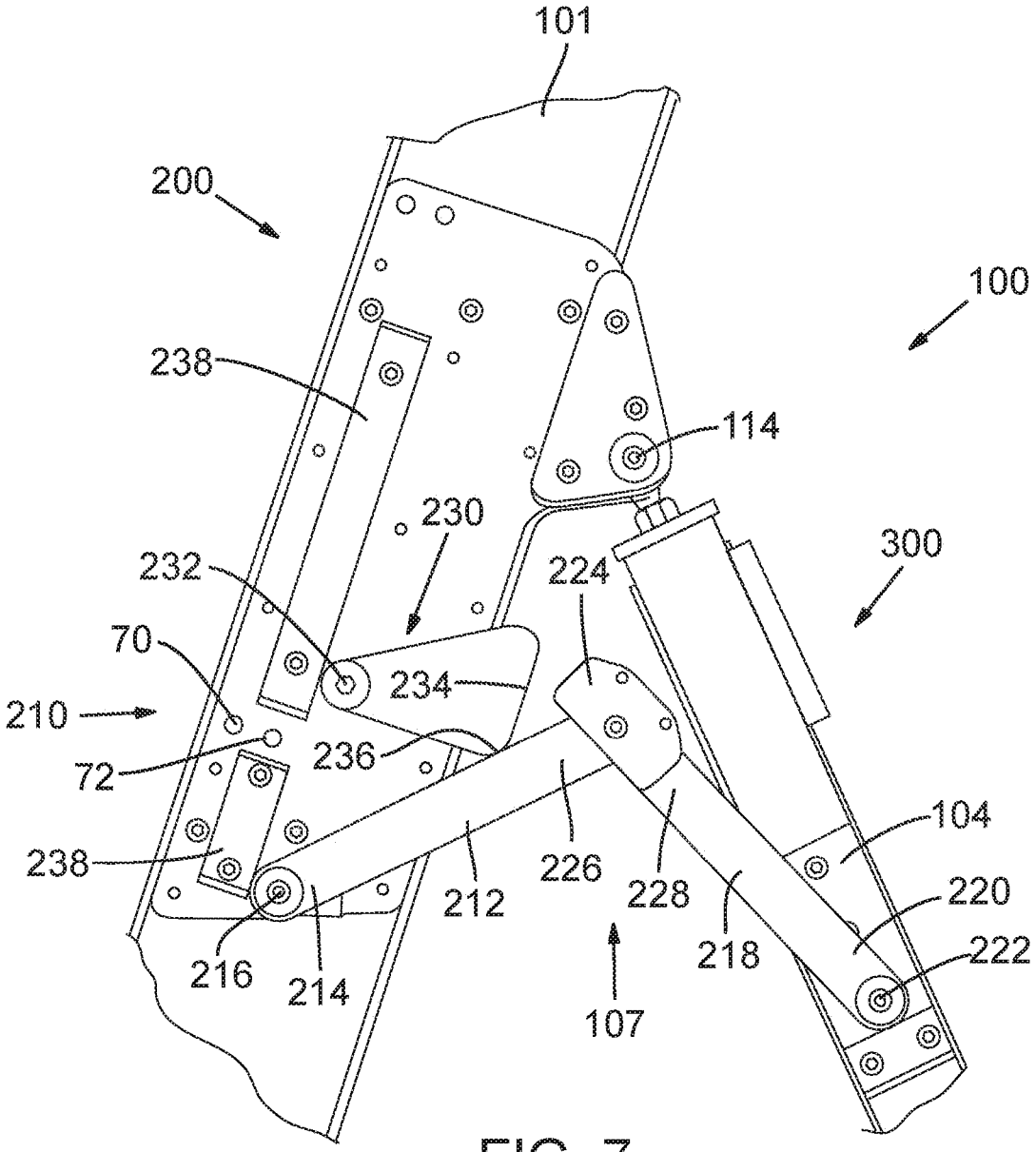
FIG. 7 is a side elevation view of the brace locking mechanism shown in FIG. 6, illustrating the mechanism being moved out of its locking position to an open position so that the ladder may be folded into its storage position.
Figure 8:
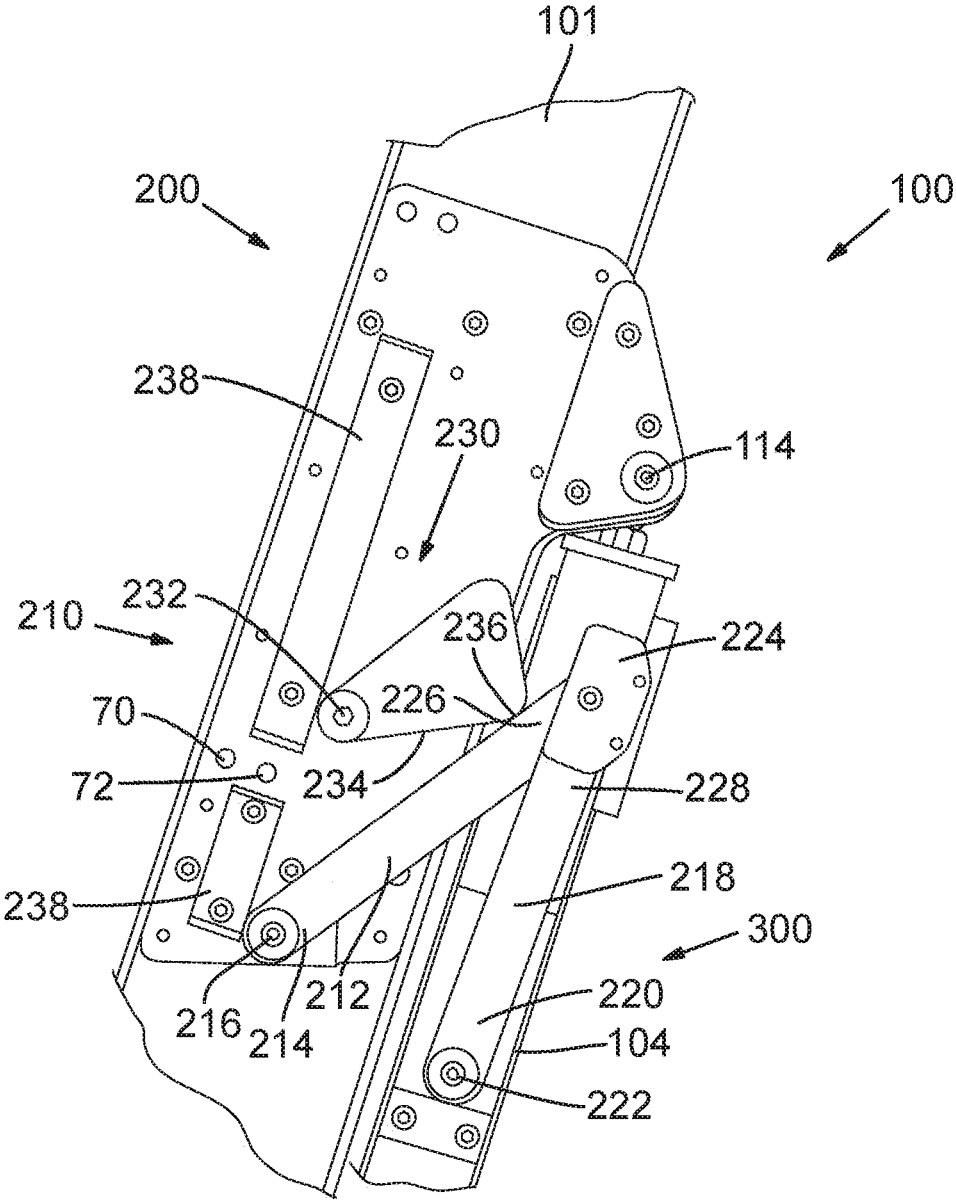
FIG. 8 is a side elevation view of the brace locking mechanism shown in FIGS. 6 and 7, and is a sequential step showing the mechanism as the ladder is moved fully into the storage position.

Reference is now made to FIGS. 6 through 8, which illustrate a brace locking mechanism 210 according to the present invention. The purpose of brace locking mechanism 210 is to lock the foldable braces 107 when the ladder 100 is in the open position. With returning reference to the basic structural components of ladder 100 described previously, and for example, as shown in FIG. 1, the brace locking mechanism of FIGS. 6 through 8 is used with a ladder 100 that has a stepped unit 200 and a support unit 300. The foldable brace 107 extends between the stepped unit and the support unit. More specifically, foldable brace 107 is a spreader bar system that is defined by a first elongate arm 212 that has its first end 214 pivotally attached to rail 101 of stepped unit 200, for example, with a bolt 216. Foldable brace 107 further is defined by a second elongate arm 218 that has its first end 220 pivotally attached to rail 104 of support unit 300 with a bolt 222. A conventional one way hinge 224 interconnects the respective, facing ends 226 and 228 of elongate arms 212 and 218. The foldable brace 107 just described is conventional and of course there is a foldable brace 107 interconnecting the rails on both sides of the ladder 100. As with known foldable braces, the one way hinge 224 is operable to limit and stop relative pivotal movements of elongate arms 212 and 218 when the support unit 300 is fully moved into the open position.

Brace locking mechanism 210 comprises a lock block 230 that is pivotally attached to rail 200 with a bolt 232. In FIGS. 6 through 8 the lock block 230 is illustrated as generally triangular in shape with the bolt 232 extending through an upper apex of the triangle, but it will be appreciated that other geometric shapes will have equivalent functionality. It will be appreciated that the major mass of lock block 230 is below the bolt 232 and the lock block will naturally swing under the force of gravity about the bolt 232 toward the position shown in FIG. 6. This is the "locked position" where the ladder 100 is in its fully open, working position. In this position the foldable brace 107 is fully extended and the base leg 234 of triangular lock block 230 is in an abutting relationship with the elongate arm 212 of foldable brace 107. When the lock block 230 is in the position shown in FIG. 6, the base leg 234 physically abuts the elongate arm 212 to thereby prevent the arm from pivoting about bolt 216. Said another way, when lock block 230 is in the locked position of FIG. 6 the foldable brace 107 cannot be moved out of the fully extended and locked position.

To move the ladder 100 out of the open position the lock block 230 is pivoted in the counterclockwise direction (in the view of FIG. 6, and as shown in the view of FIG. 7) about bolt 232. Movement of lock block 230 in the counterclockwise direction disengages the abutting relationship between base 234 of the lock block 230 and elongate arm 212; once the block 230 has been rotated sufficiently that the base 234 has been moved away from arm 212, the foldable brace 107 may be pivoted in a conventional manner about its respective ends, which of course allows the support unit 300 to be pivoted toward the stepped unit 200, out of the work position and into a storage position.

FIG. 7 is the next sequential step in the movement of the ladder 100 from the fully open position to the storage position. As may be seen, as the support unit 300 is moved partially toward the stepped unit 200 so that the ladder 100 is in an intermediate folded position between the fully open and fully closed positions. Elongate arm 212 pivots about bolt 216 and the elongate arm makes contact with the lock block 230 and pushes on the lock block as the ladder is moved toward the closed position, thereby causing the lock block to continue rotation about bolt 232 as the ladder is moved toward the storage position. The rounded corner 236 of lock block 230 eases the rotation of the lock block by the pushing contact of the elongate arm. An elongate blocking member 238 is bolted to rail 101 and is position such that the blocking member 238 prevents over rotation of lock block 230 when the ladder is fully closed—the blocking member 238 may be provided in multiple pieces as shown in FIG. 7, or in a single piece, which is not illustrated. The purpose of the split, multi-piece blocking member 238 shown in FIG. 6 is to allow attachment of a handrail to bores 70 and 72 in the rails, as detailed below.

FIG. 8 further illustrates the brace locking mechanism 210 described above. Sequentially, in FIG. 8 ladder 100 is in the full storage position and it may be seen that brace locking mechanism 210 does not interfere with the stepped and storage units in this position.

It will be appreciated that when ladder 100 is moved to its open position (FIG. 6) from the storage position (FIG. 8), the brace locking mechanism 210 automatically moves into the locked position when the ladder is fully open because the lock block 230 is, relative to the pivot point defined by bolt 232, bottom weighted. Specifically, when the support unit 300 is pivoted about hinge axis 114 and fully away from the stepped unit 200 in the working position, and such that foldable brace 107 is in its engaged position (FIG. 6), the lock block 230 rotates under the force of gravity (in the clockwise direction in FIGS. 6-8) and into the locked position. Thus, no operator intervention is required to lock the ladder securely in the work position. In the locked position, the ladder 100 may be moved from one position to another, or rolled on wheels from one location to another where the ladder incorporates wheels without disengaging the brace locking mechanism. To fold the ladder into its storage position, the user must affirmatively rotate the lock block 230 away from its locked position and also disengage the one way hinge 224 of foldable brace 107.

The brace locking mechanism 210 described above may be used with any foldable ladder and is not limited to the cantilevered ladder 100 described herein. In a preferred embodiment a brace locking mechanism is provided on each rail 101. In another preferred embodiment, only one brace locking mechanism is provided on one of the two rails 101. Further, it will be appreciated that the lock block described above may be attached to the rails 104 of the support unit 300 to define a functionally equivalent brace locking mechanism.

Although not shown in the drawing, the brace locking mechanism 210 may also incorporate a spring that functions to normally drive the lock block 230 into the locking position. The lock block could be move out of the locking position by rotating it in the counter clockwise direction (of the drawings) against the force of the spring. Further, the locking mechanism 210 may include a safety-type mechanism that secures the lock block 230 in the locked position, such as a ball detent or a locking pin and the like. Those of skill in the art will also recognize that there are numerous structural equivalents to lock block 230 that perform the same function. As a few examples, clevis pins inserted through a bore in rail 101 adjacent or through arm 212; a spring-loaded clamp oriented either above or below arm 212 such that the clamp secures the arm when the ladder is in the open position.

The present invention further contemplates the use of an extension module that may be attached to the upper end of the stepped unit to increase the usable length of the ladder.

Figure 9:
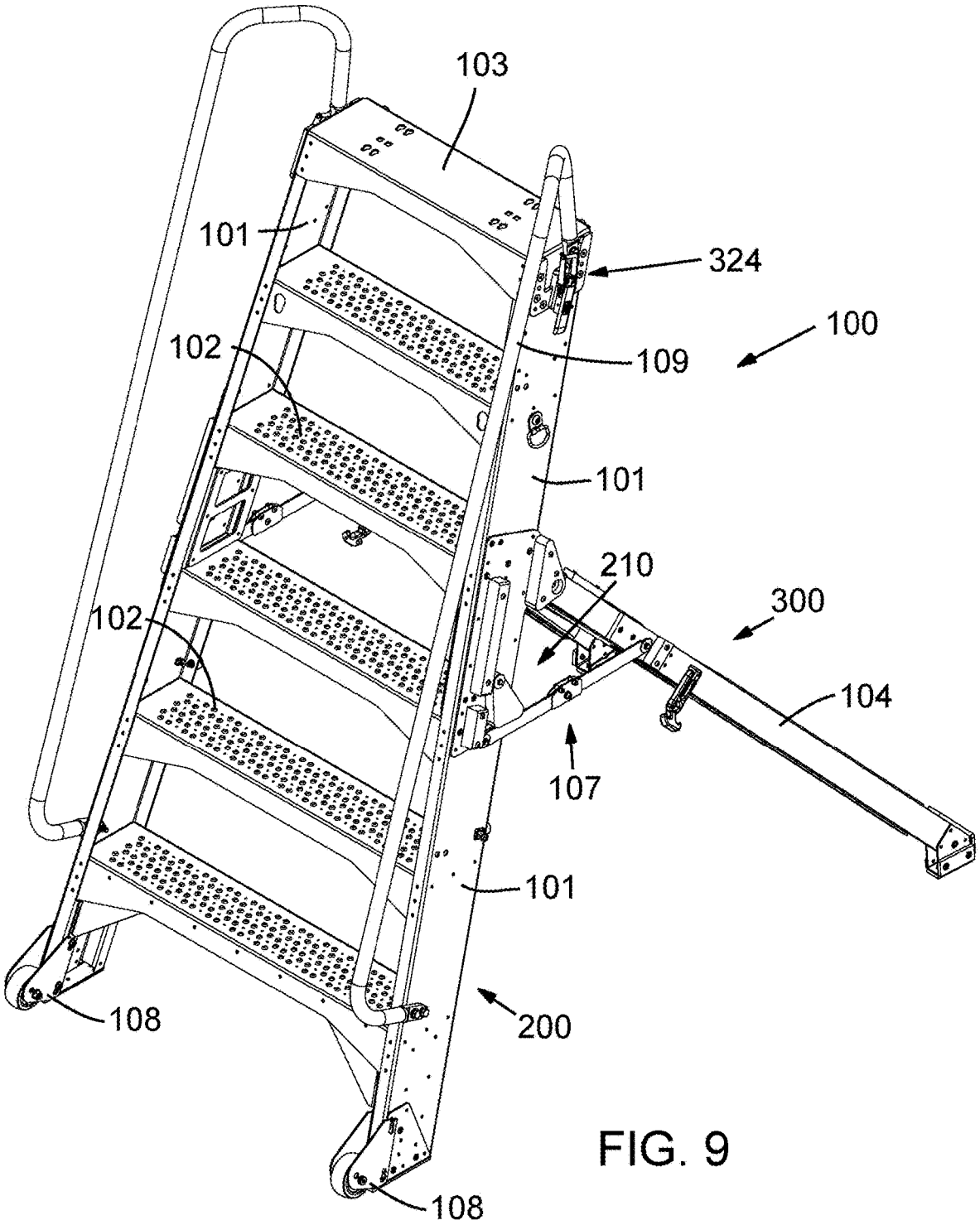
FIG. 9 is an upper perspective view of one embodiment of a ladder according to the invention, showing the ladder in the working position; the ladder shown in FIG. 9 incorporates structures that allow extension modules to be attached to the ladder.

Reference is now made to the drawings of FIGS. 9 through 19, which illustrate an extension module that is attached to ladder 100 to increase the working height of the ladder and the connecting structures that securely interconnect the extension module with the ladder. A ladder 100 that is designed for use with an extension module 310 defines the base module to which the extension module is attached, and includes cooperatively constructed interconnecting structures on the ladder 100 and the extension module 310 that operate to secure the extension module to the ladder. Different embodiments of these interconnecting structures are described below. In the illustration of FIG. 9, a ladder 100 is illustrated without an extension module 310 but including one element of an interface connector 324, that is, the half of the cooperative interface connector that is attached to the upper end of rail 101. The interface connectors 324 are described in detail below.

Figure 10:
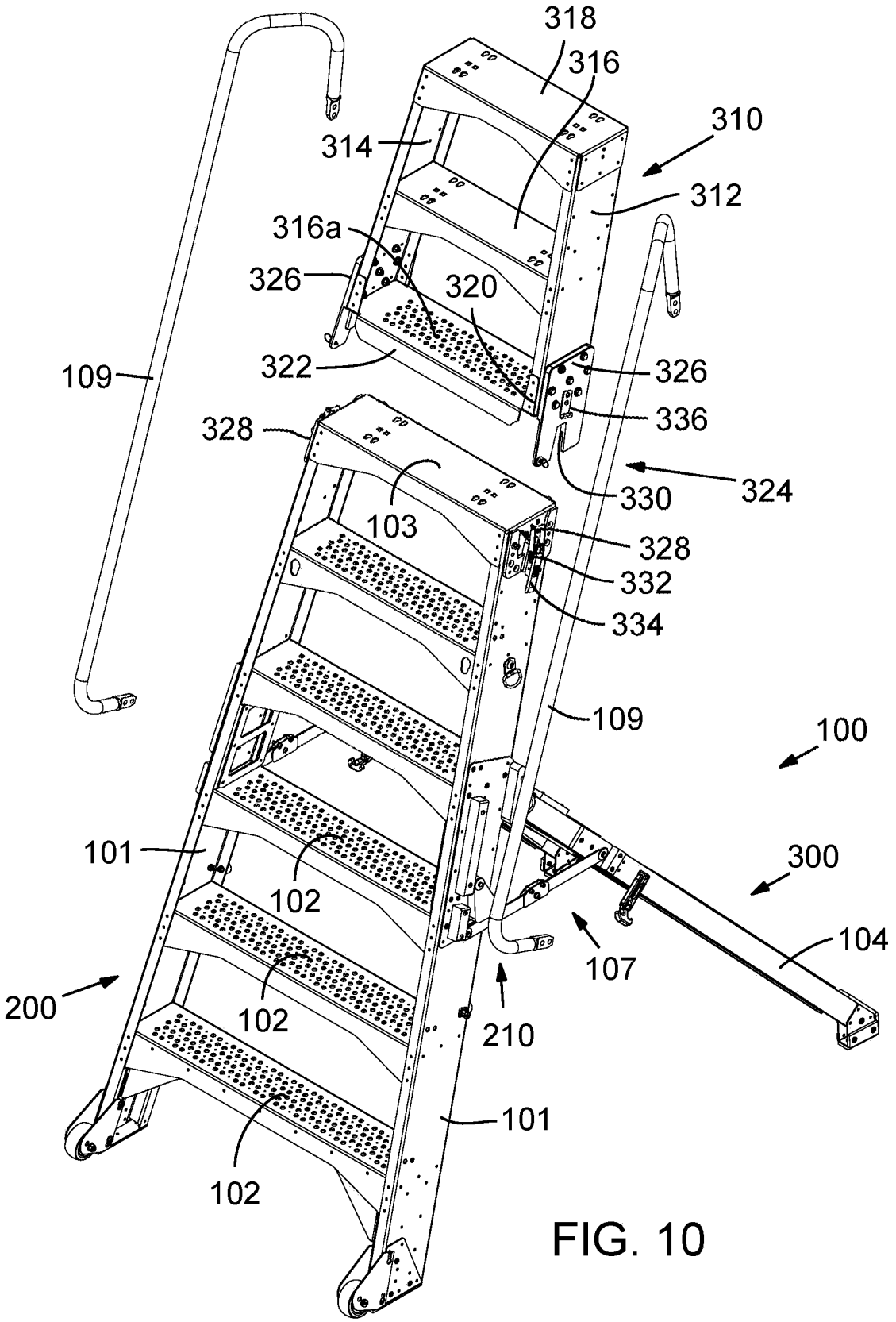
FIG. 10 is an upper perspective view of one embodiment of a ladder according to the invention, showing the ladder in the working position, with an extension module juxtaposed adjacent the ladder in exploded view.

With specific reference to FIG. 10 a ladder 100 as described above and includes the stepped unit 200 that is defined by side rails 101 interconnected with steps 102 and a top plate 103. Ladder 100 further includes the support unit 300. The extension module 310 is shown juxtaposed relative to and separated from the top plate 103. Extension module 310 is defined by opposed side rails 312 and 314 that are interconnected by plural steps 316 and top plate 318 in a manner analogous to the analogous components of ladder 100 described previously. The extension module 310 is sized appropriately that it mates with an existing ladder 100 in order to allow the extension module to be securely coupled to the ladder in the manner detailed below. The lowermost step of extension module 310 is labeled as step **316*a* and is located near the lower ends 320 of opposed rails 312 and 314 so that the lowermost step 316*a* abuts the top plate 103 of ladder 100 and the rails 312 and 314 align with rails 101 of stepped unit 200. A flange 322 extends downwardly from step 316*a* and overlaps with the forward edge of top plate 103 when the extension module is attached to the ladder. An identical flange (not visible in the view of FIG. 10) extends downwardly from step 316*a* on the opposite side of the step from that shown in FIG. 10—and overlaps with the opposite edge of the top plate 103 when the extension module is coupled with the ladder. The handrails 109 are also shown juxtaposed from the ladder 100 shown in FIG. 10. The handrails are securely attached at their bottom ends to the opposed rails 101 with, for example, bolts or quick release skewers that extend through bores in the handrails and through bores 70 and 72 (see, e.g., FIG. 8). The upper ends of the handrails 109 are attached to the upper ends of the opposed rails 312 and 314** in a like manner.

It will be noted that the physical spacing between top plate 103 and the closest adjacent step 102 is slightly less than the spacing between other steps 102 of the ladder 100. When the extension module 310 is mated to ladder 100, the top plate 103 of ladder 100 is, as noted above, brought into abutting or very close proximity with the lowermost step **316*a* of the extension module 310. This abutting relationship between the top plate 103 and the step 316***a* defines a step spacing that is consistent with the other step-to-step spacing of ladder 100. This structural arrangement also strengthens and adds rigidity to the interconnection between the extension module 310 and the ladder 100, thereby contributing to a solid connection between the two units, and the overlap of flanges 322 with top plate 103 effectively transforming the combined step into a fully functional step.

While the abutment of step 316*a* with top plate 103 contributes to the stability of the interconnection between the extension module 310 and the ladder 100, the primary interconnection between the two is provided by interface connectors, referred to generally with reference number 324. A first embodiment of an interface connector 324 is shown in the views of FIGS. 10 through 15 and comprises a first plate 326 that is securely attached to the lower end 320 of rail 312 of extension unit 310 such that a portion of the first plate 326 extends beyond the end of the rail 312. Likewise, an identical first plate 326 is attached in the same way to the lower end 320 of rail 314. A second plate 328 is securely attached to the upper end of rail 101 adjacent top plate 103—one second plate 328 is attached to each rail 101.

The first and second plates 326 and 328, respectively, include structural features that contribute to a highly secure and stable connection between the extension module 310 and the ladder 100. With continuing reference to FIG. 10, first plate 326 has a generally V-shaped notch 330 formed in the lower edge of the plate. Second plate 328 includes a cooperatively formed V-shaped extension 332 facing V-shaped notch 330. When extension module 310 is connected to ladder 100 the V-shaped extension 332 of second plate 328 is received in the cooperatively formed V-shaped notch 330 of first plate 326, thereby stabilizing the interconnected first and second plates. Further, a pull-action toggle clamp 334 is attached to second plate 328 and a corresponding latch plate 336 with a hook portion is attached to first plate 326. When extension module 310 is connected to ladder 100 the arms 338 of the toggle clamp 334 (see FIG. 12) are extended over the corresponding hook portion of latch plate 336 and the toggle clamp is closed. This further secures the extension module 310 to the ladder 100, and the pulling action of the toggle clamp 334 adds additional strength to the interconnection. There is a toggle clamp 334 attached to each of the second plates 328 of ladder 100, and of course, the relative positions of the toggle clamp and the latch plates on first and second plates 326, 328 may be reversed.

Figure 11:
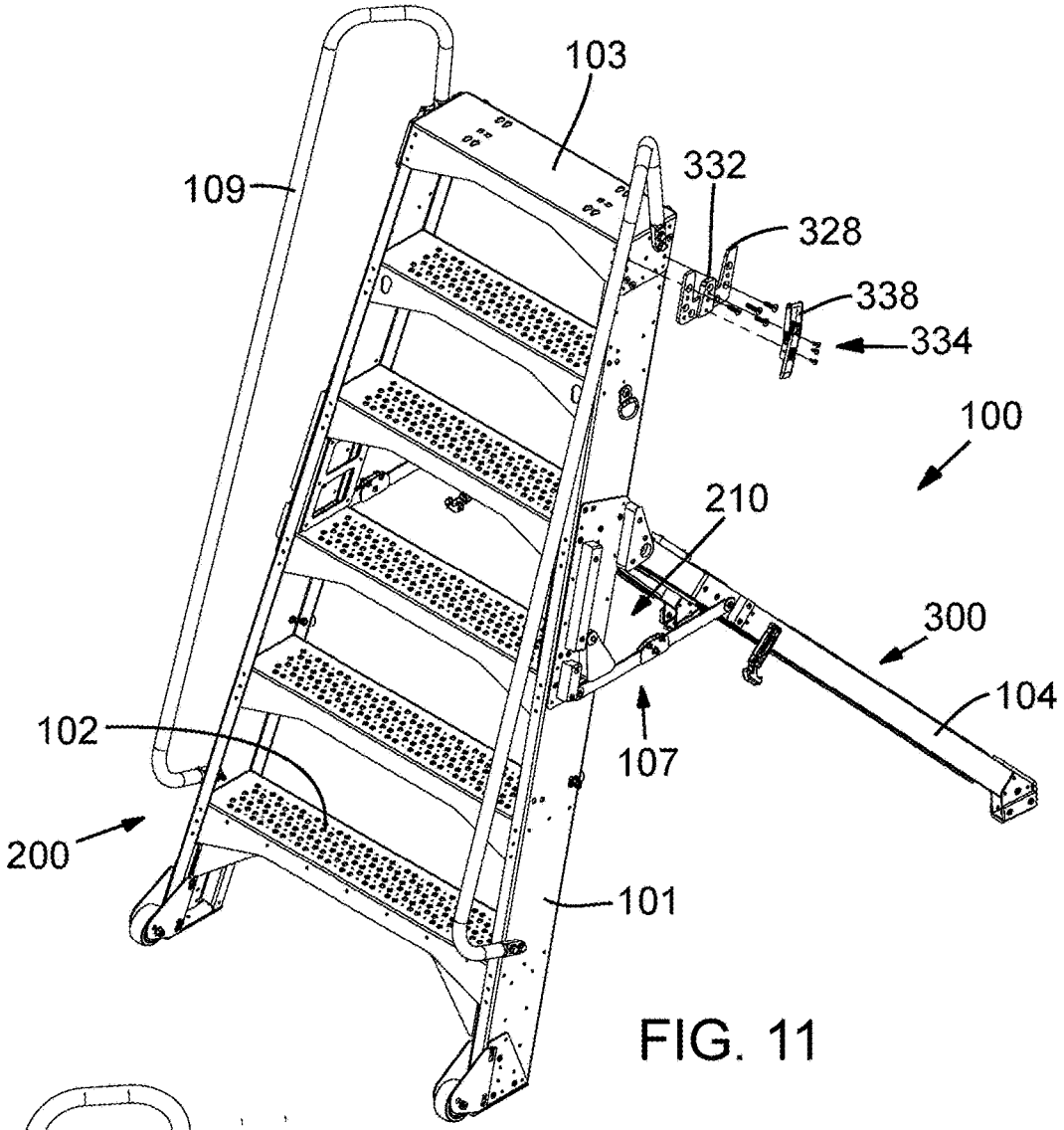
FIG. 11 is a close up perspective and exploded view of the upper end of the ladder shown in FIG. 10, showing in exploded view a first embodiment of a coupling mechanism according to the invention for secure attachment of an extension module to the ladder.
Figure 12:
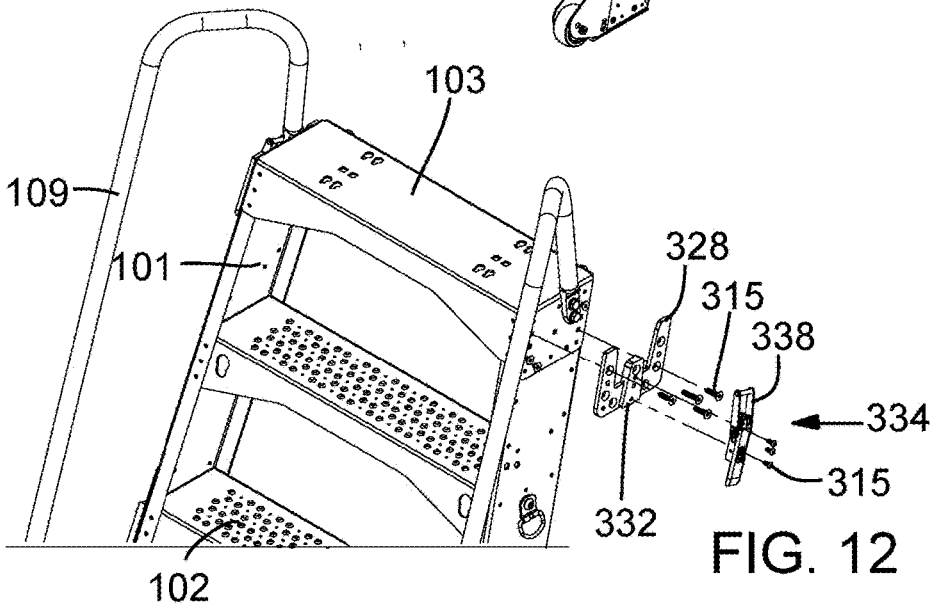
FIG. 12 is a close up, perspective and exploded view the close-up circle of FIG. 11 to illustrate the coupling mechanism.

The structure of the second plate 328 is shown in the close up and exploded views of FIGS. 11 and 12. Each of the second plates 328—i.e., one plate 328 is attached to each of the rails 101 of ladder 100—is secured to the upper edge 313 of a rail 101 with plural fasteners such as screws 315.

Figure 13:
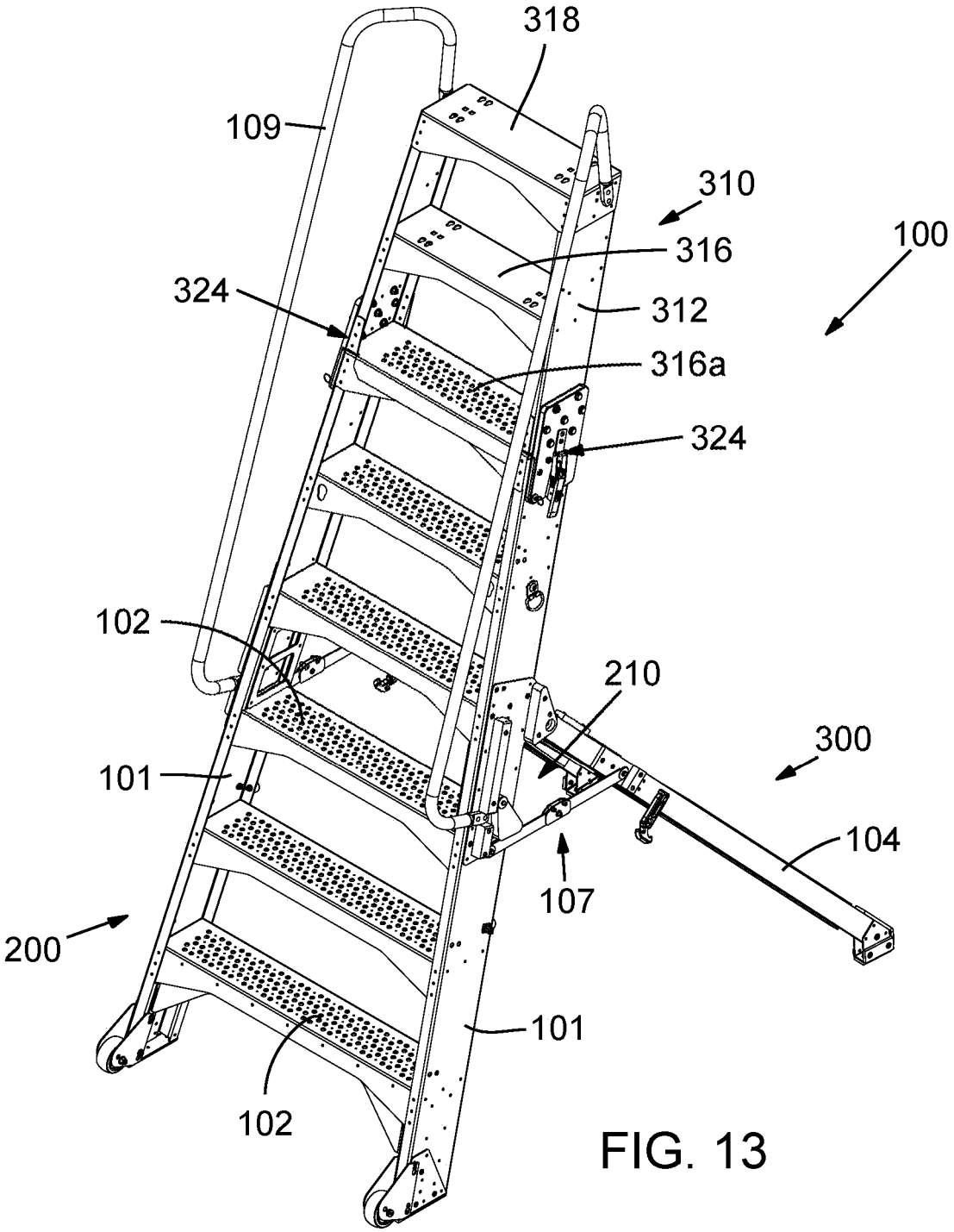
FIGS. 13 through 15 show three different ladders according to the invention in which extension modules of different lengths have been securely coupled to the ladder in order to extend the working length or height of the ladder. Specifically.
Figure 14:
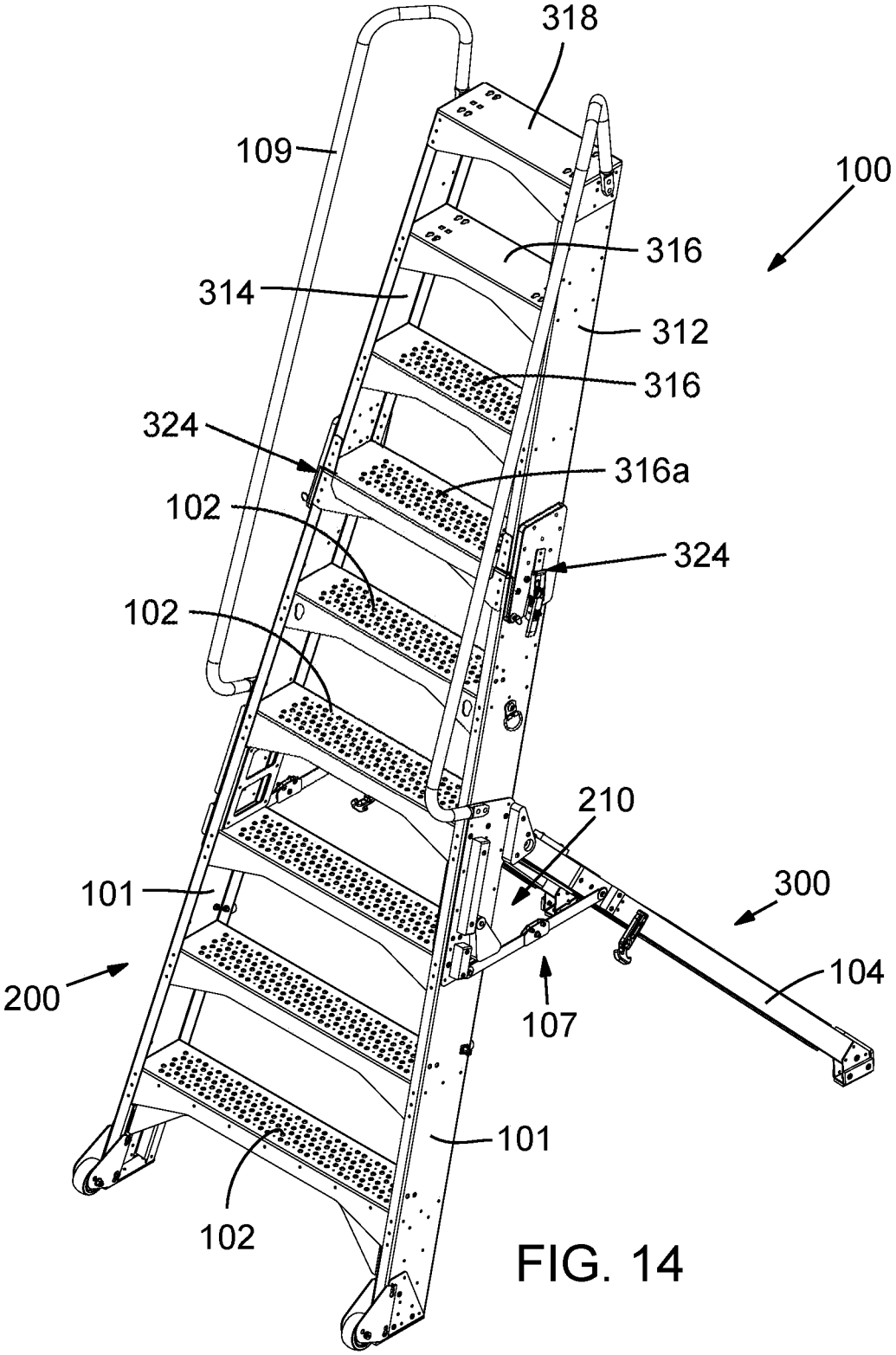
Figure 15:
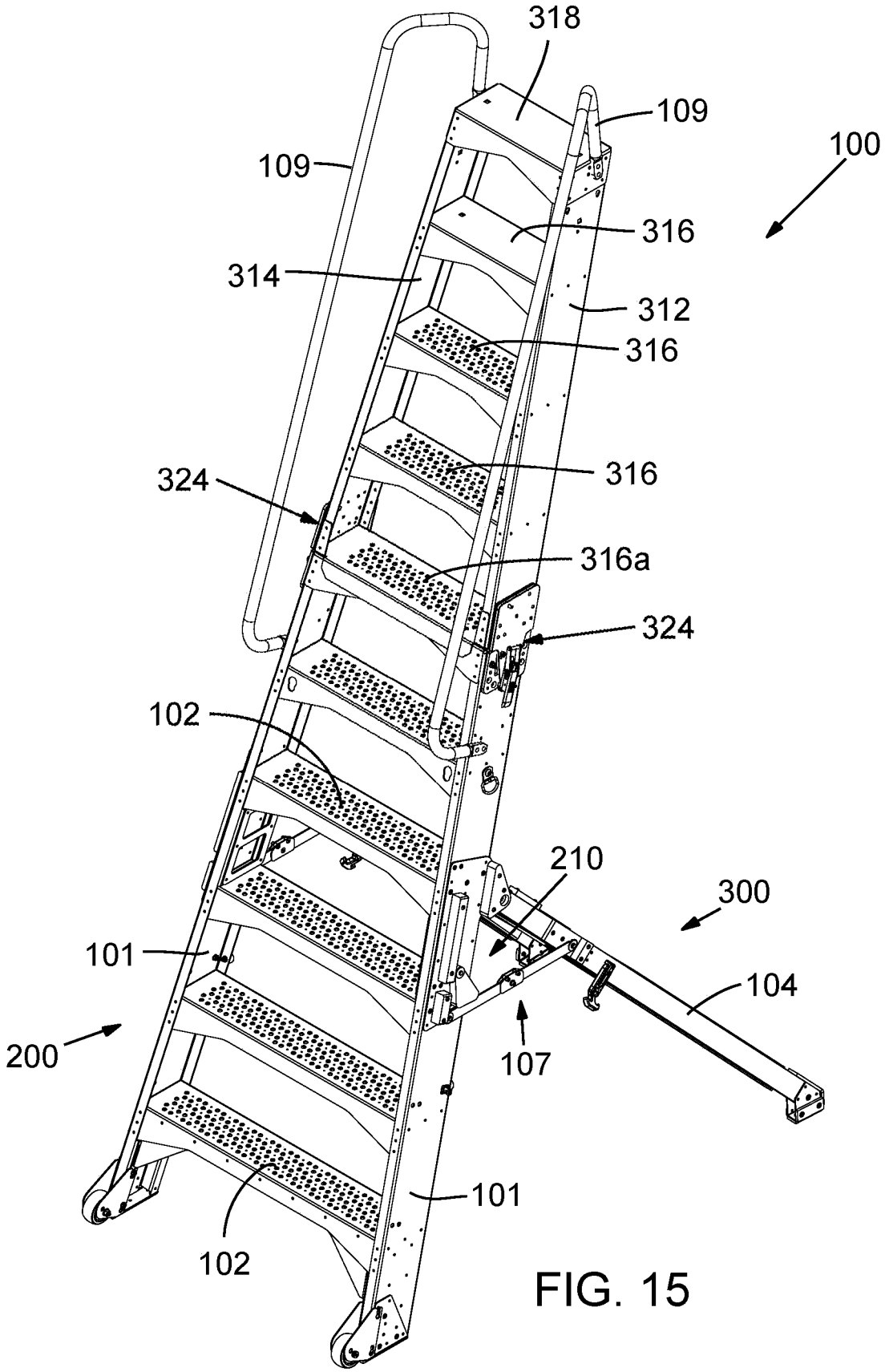
Figure 16:
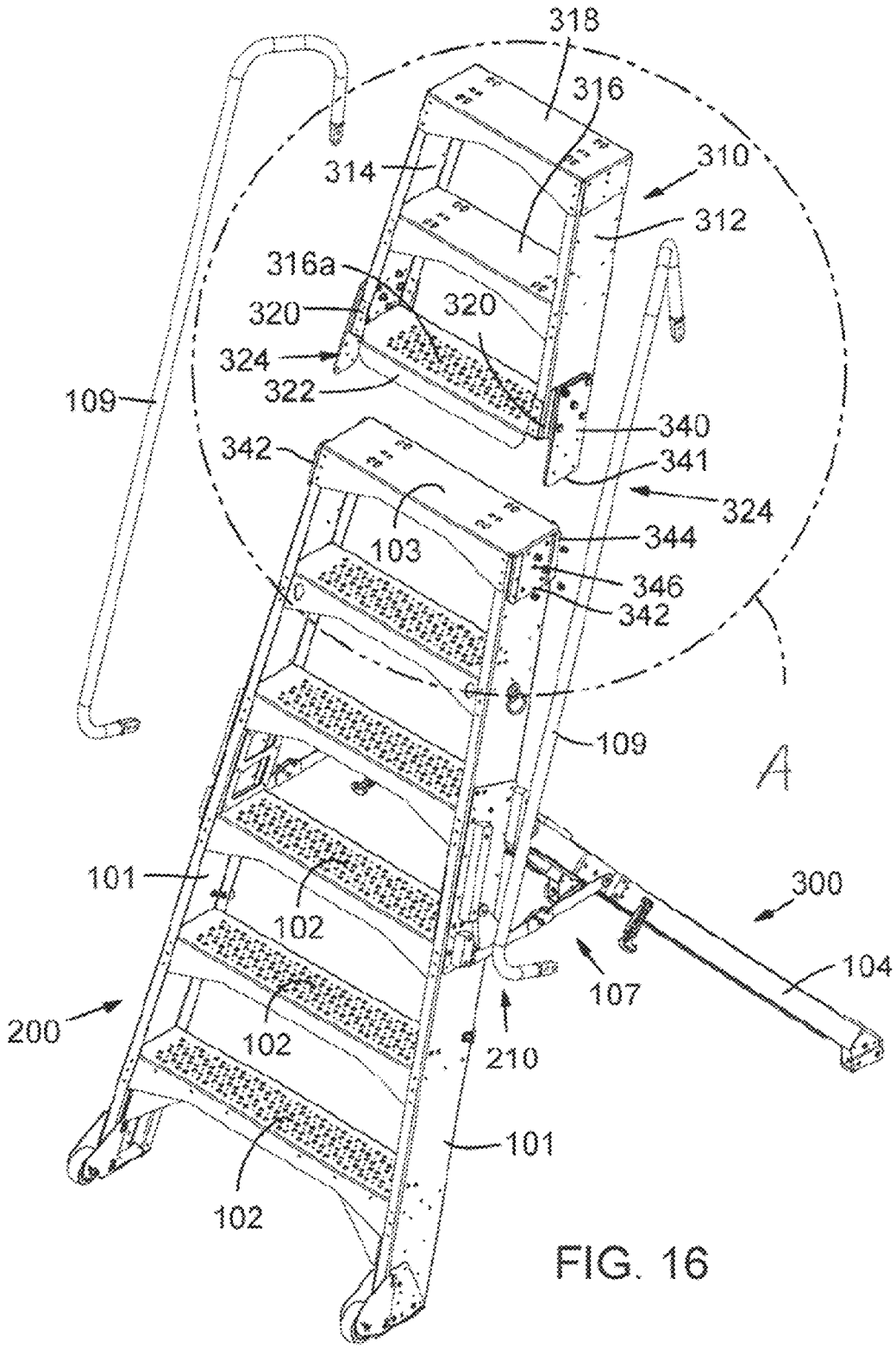
FIG. 16 is a perspective and partially exploded view of a ladder according to the invention and illustrating a second embodiment of a coupling mechanism that may be used to secure an extension module to the ladder base.
Figure 17:
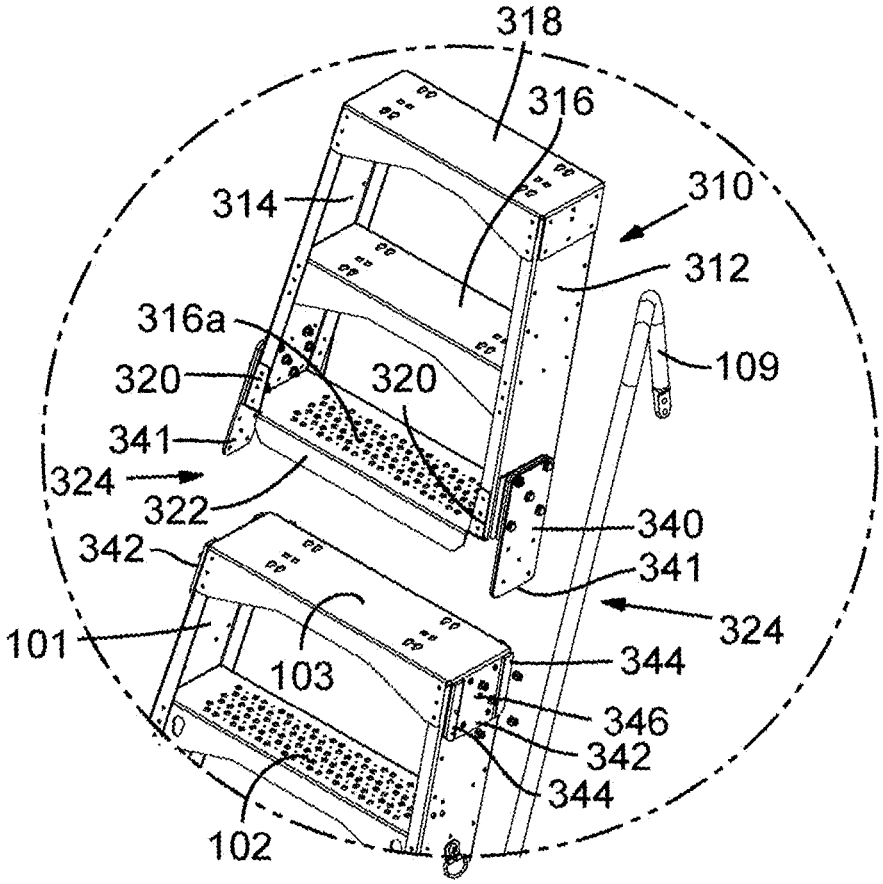
FIG. 17 is a close up, perspective and exploded detail view of area A FIG. 16.

The length of extension module 310—that is, the number of steps 316 that may be incorporated into the extension module, may be varied and the maximum length of the extension module is dictated in large part by the specific dimensions of the ladder 100 to which the extension module 310 is to be coupled. FIGS. 13, 14 and 15 depict identical ladders 100 with three differently sized extension modules 310 coupled thereto with interface connectors 324 of the type described above. The ladder 100 in FIG. 13 has an extension module 310 with two steps 316 and a top step 318; the ladder 100 in FIG. 14 has an extension module with three steps 316 and a top step 318; and the ladder 100 in FIG. 15 has an extension module with four steps 316 and a top step 318.

Those of skill in the art will recognize that there are numerous structural equivalents that may be utilized to define the interface connectors 324 that couple the extension module 310 to the ladder 100, in addition to the embodiment described above in respect of FIGS. 9 through 15. A second embodiment of an interface connector 324 is shown in FIGS. 16 through 19. In the second embodiment a first plate 340 is securely attached to the lower end 320 of rail 312 of extension unit 310 and a portion of the first plate 340 extends beyond the end of the rail 312 to define a bayonet 341. An identical first plate 340 is attached in the same way to the lower end 320 of rail 314. Bayonet 341 may be an integral part of first plate 340, or may be attached to plate 340 as a separate piece. A second plate 342 is securely attached to the upper end of rail 101 adjacent top plate 103—one second plate 342 is attached to each rail 101. Second plate 342 includes shoulders 344 at the opposite lateral sides of the plate to define a channel 346 there between—the shoulders 344 may be formed as an integral part of the plate 342 or attached to the plate as separate pieces. The channel 346 has parallel side walls defined by the shoulders 344 and the width of the channel is adapted to be the same as the width of bayonet 341. As best seen in the close up view of FIG. 19, when extension module 310 is mated with ladder 100 the bayonet 341 is slid into the channel 346 and the mating structures help to stabilize the interconnected components. Further security between the extension module and the ladder is provided by securing the bayonet 341 to the second plate 342, for instance, with fasteners such as screws or threaded bolts that connect the two or with a latch similar to toggle clamp 334 described above, and more particularly with a bolt threaded through the aligned bores 343 and 345 in first plate 340 and second plate 342, respectively.

When an extension module 310 is coupled to a ladder 100 as described above the stepped base unit has support legs that are of sufficient length to support a step ladder of substantially greater length than the height of the base unit itself and the added height is provided by the extension module. In conventional step ladder designs, the stepped unit and the support unit are angled symmetrically and assume the shape of an isosceles triangle when the ladder is in its open position. But in the design of the present invention the angle measured between the stepped unit and the ground is greater than the angle measured between the support unit and the ground and when the ladder 100 is folded into its storage position the lower portion of the rails of the support unit extend beyond the feet of the stepped unit. Accordingly, this combination of structural features allows the ladder 100 to provide a footprint that is larger than footprint of a convention ladder, assuming isosceles triangle construction. In this way the ladder 100 with the extension module with its added steps securely coupled to the stepped unit will exhibit stability comparable to or greater than that of a conventional step ladder of similar height.

Figure 18:
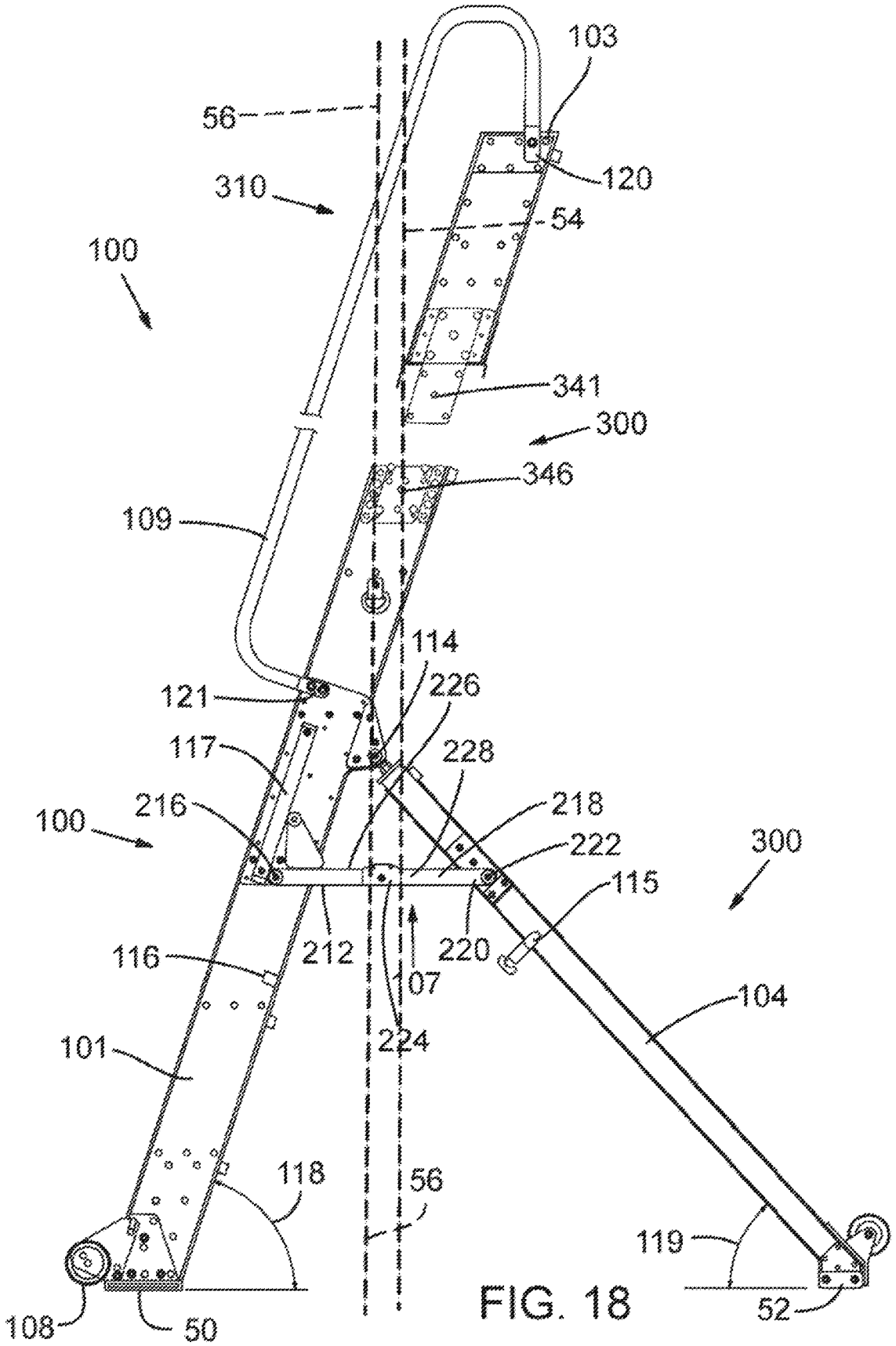
FIG. 18 is a side elevation view and partially exploded of a ladder according to the present invention in which an extension module is shown in a position ready to be secured to the ladder base.

Further, as may be seen in FIG. 18 and as noted above in respect of FIG. 4, it may be seen that when the ladder 100 is in the open, working position, the top plate 103 and the interconnection with extension module 310 is located beyond the hinge axis 114. In the view of FIG. 18, the triangle defined by the lines interconnecting the hinge axis 114, foot 50 and foot 52, the horizontal location of top plate 103 is to the right of hinge axis 114 and to the left of foot 52. Accordingly, when the ladder 100 is in the open position as shown and located on a horizontal ground plane, then a vertical line drawn from the top plate 103 to the ground plane intersects the line extending from the foot 50 to the foot 52 at a position intermediate between the intersection of a line extending from hinge axis 114 to the line extending from the foot 50 to the foot 52. These two vertical lines are illustrated in phantom lines in FIG. 18, labelled with reference numbers 54 and 56, respectively.

In addition to the interface connectors 324 that are described above, other suitable methods of securely attaching an extension module 310 to the ladder 100 include hinged connections, tapered joints with cooperative tapered receivers, finger joints, dovetail joints, wedge plates and others. Similarly, there are numerous ways to attach the interface connector components, including for example bolts and screws, pit pins, claims, hand wheels, etc.

Figure 20:
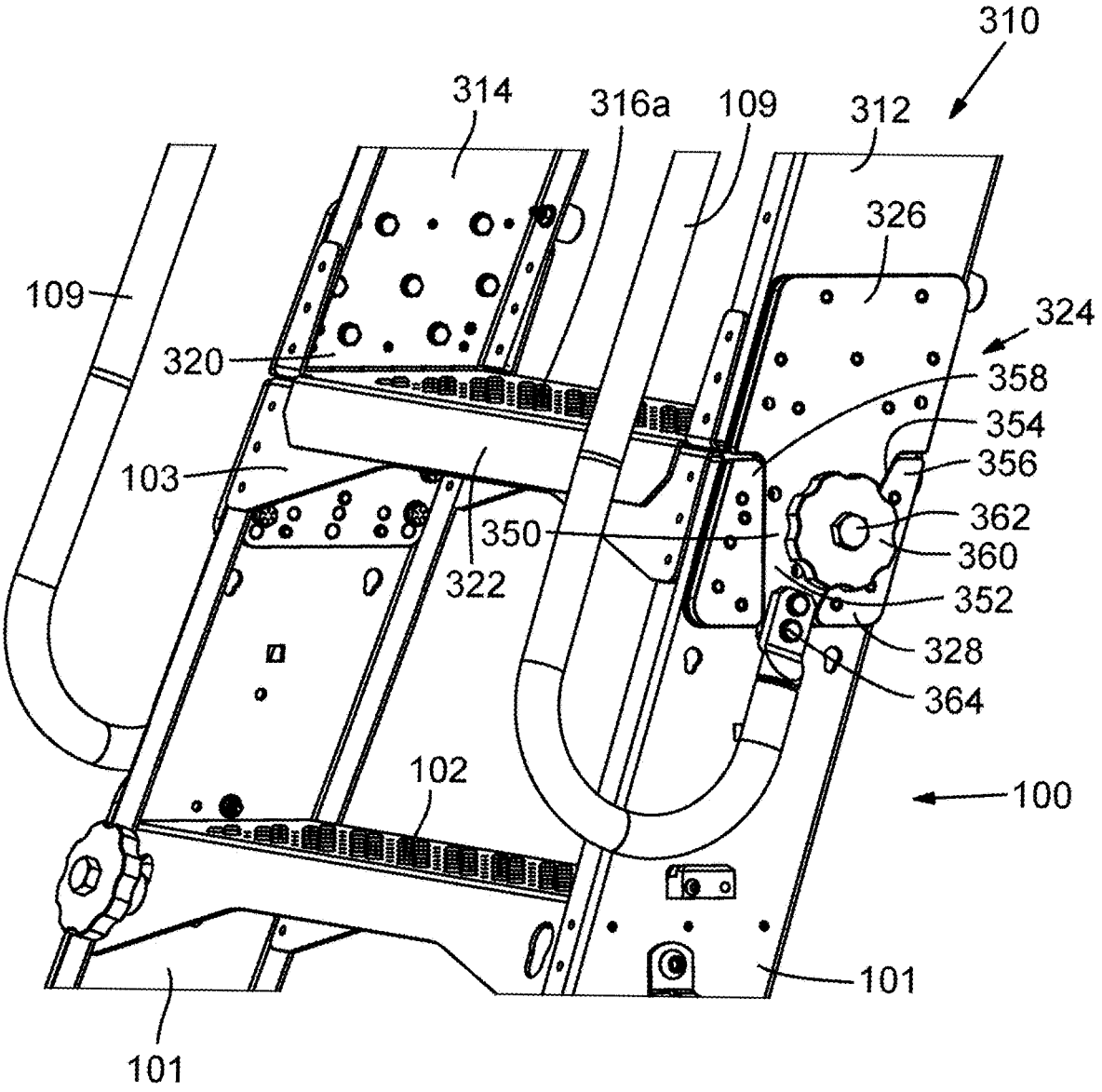
FIG. 20 is a close up perspective view of an alternative embodiment of a coupling mechanism for securing an extension module to a ladder.

Reference is now made to the alternative embodiment of an interface connector/coupling mechanism 324 for securing an extension module 310 to a ladder 100 as shown in FIG. 20. In the embodiment of FIG. 20 the first plate 326 is securely attached to the lower end 320 of rail 312 (with fasteners such as screws) and includes a downwardly oriented and substantially triangular extension 350 that has its apex 352 oriented at the lower end of the plate 326. The second plate 328 is securely attached to the upper end of rail 101 of ladder 100, adjacent top step 103 as shown and defines a cooperative structure for receiving the triangular extension 350 in a mating relationship. More specifically, second plate 328 forms a V-shaped notch 354 into which the triangular extension 350 is received. The second plate may be formed from two mirror image halves such as halves 356, 358 (as shown in FIG. 20), or alternately, the second plate 328 may be fabricated from a single plate of material.

When the extension module 310 is assembled onto a ladder 100 as shown in FIG. 20 the triangular extension 350 is received in the V-shaped notch 354 such that the sides of the extension align with and abut the facing sides of the notch. This in itself provides a stable and secure interconnection between the extension module and the ladder. However, a fastener is always provided to attach the extension 350 to the ladder 100 and in the instance of the embodiment of FIG. 20, a hand wheel 360 with a threaded bolt 362 extending therethrough is extended through a bore in the triangular extension 350 (the bore is not shown because it is blocked in the view of FIG. 20 by the hand wheel) and is screwed into an aligned threaded bore in rail 101 of ladder 100 (the treaded bore also is blocked in the view of FIG. 20). The hand wheel 360 and bolt 362 provide additional security for attaching the extension module 310 to ladder 100, and of course there is an identical coupling mechanism 324 associated with the rails on the opposite side of the ladder from that shown in the view of FIG. 20. As also seen in FIG. 20, the end 364 of handrail 109 in the embodiment of FIG. 20 is secured to the triangular extension 350 with a pair of bolts 364.

Figure 21:
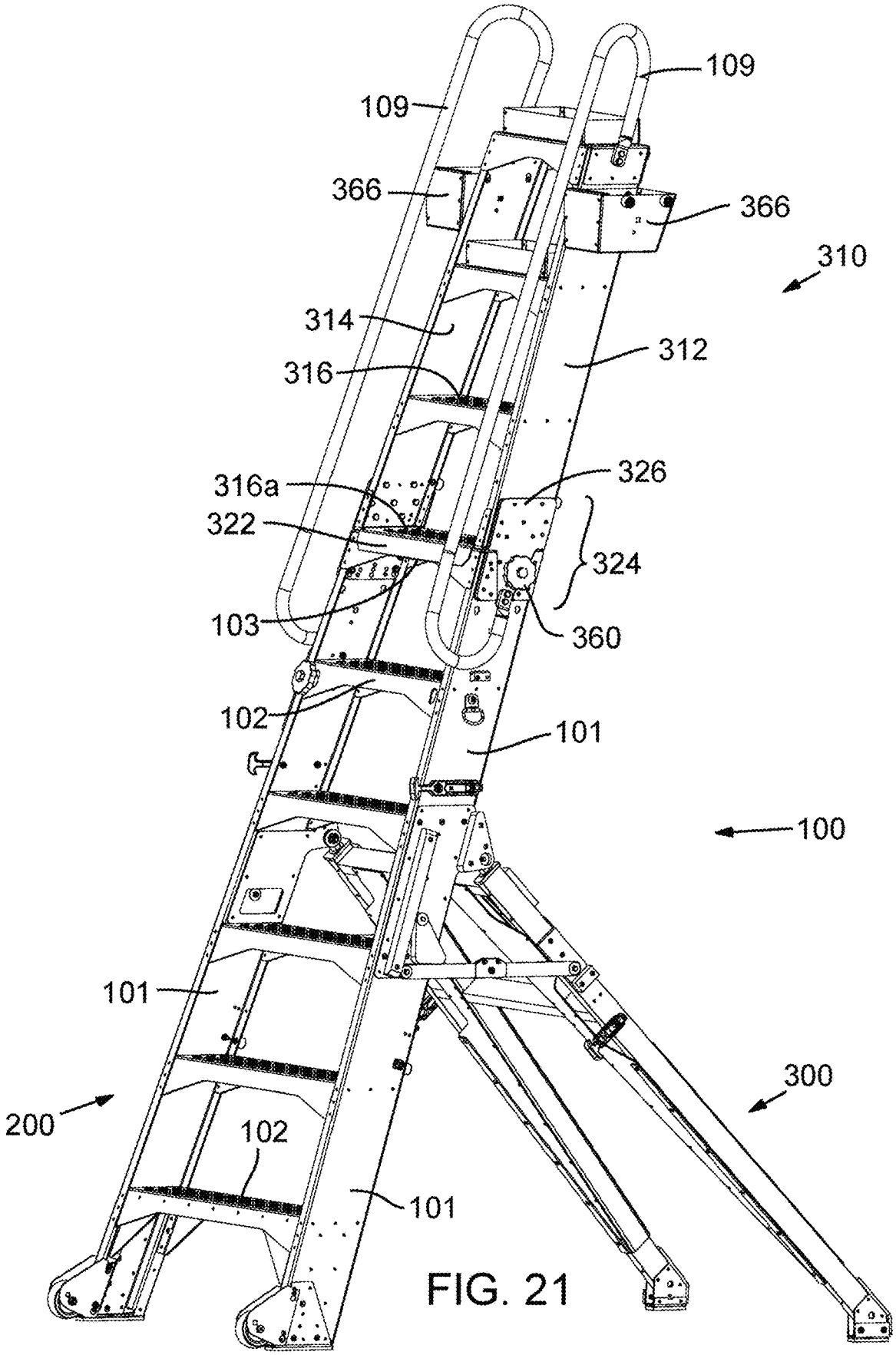
FIG. 21 is a perspective view of a ladder having an extension module secured thereto using the coupling mechanism shown in FIG. 20.

A ladder 100 having an extension module 310 secured to it with the coupling mechanism 324 as shown in FIG. 20 is illustrated in FIG. 21. A tool tray 366 is attached to each of the rails 312 and 314 in positions that allow a user to conveniently store tools and the like. The tool trays may be relocated wherever the user finds convenient with appropriate fasteners.

Figure 19:
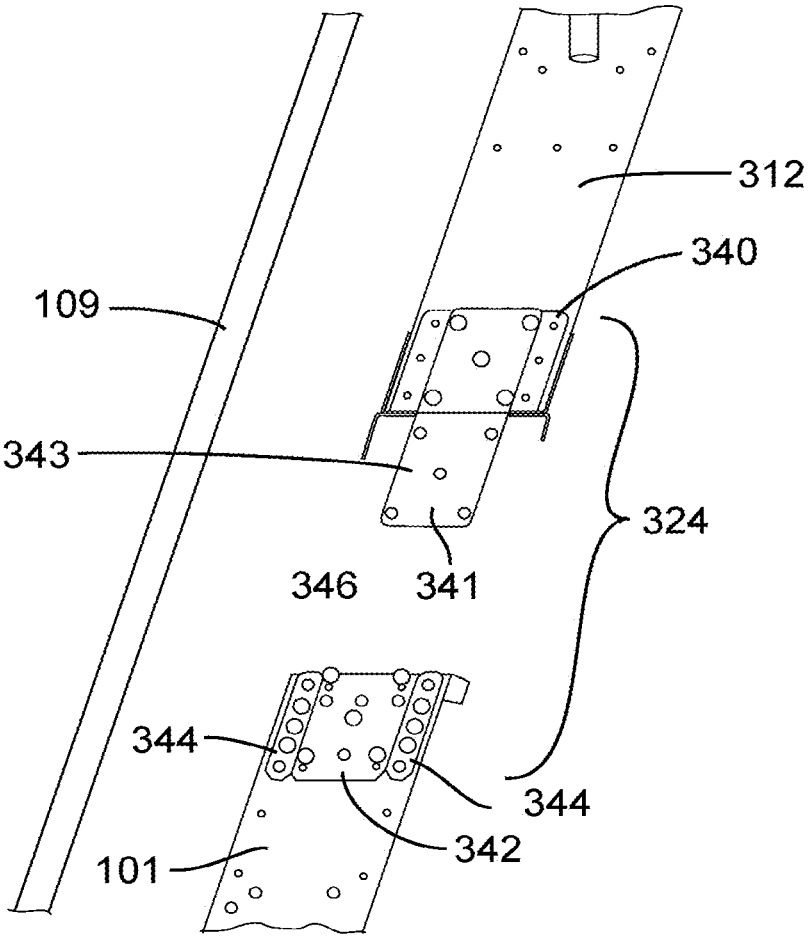
FIG. 19 is a close up and side elevation view of the portion of FIG. 18 that is shown in a close-up circle, illustrating the coupling mechanism for securing the extension module to the ladder base is illustrated.

It will be appreciated that the embodiments of the coupling mechanisms 324 shown in, for instance, FIGS. 13, 19 and 20 provide very secure and stable interconnections between the ladder 100 and the extension module 310. The cooperative geometric configurations of the first plates and the second plates of the coupling mechanisms provide a primary stabilizing and securing modality, and secondary stabilizing and securing modality is provided by the attachment mechanisms defined by, for instance, the toggle 334 (FIG. 12), the interconnecting bolt (FIG. 19) and the hand wheel 360 (FIG. 20).

Figure 22:
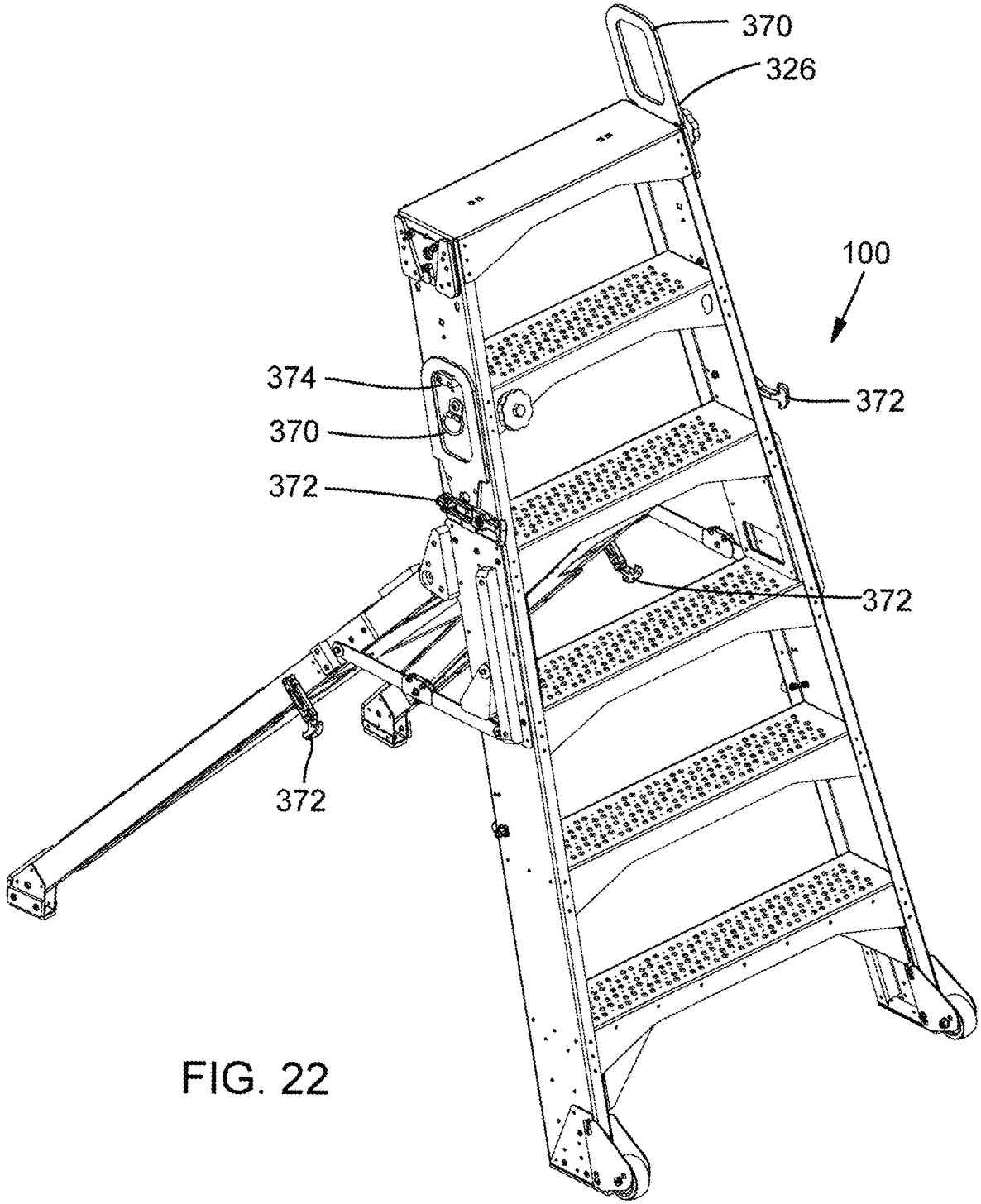
FIG. 22 is a perspective view of a ladder according to the invention that is adapted to use the coupling mechanism illustrated in FIG. 20 but in which one component of the coupling mechanism is modified to be also used as a hand hold.
Figure 23:
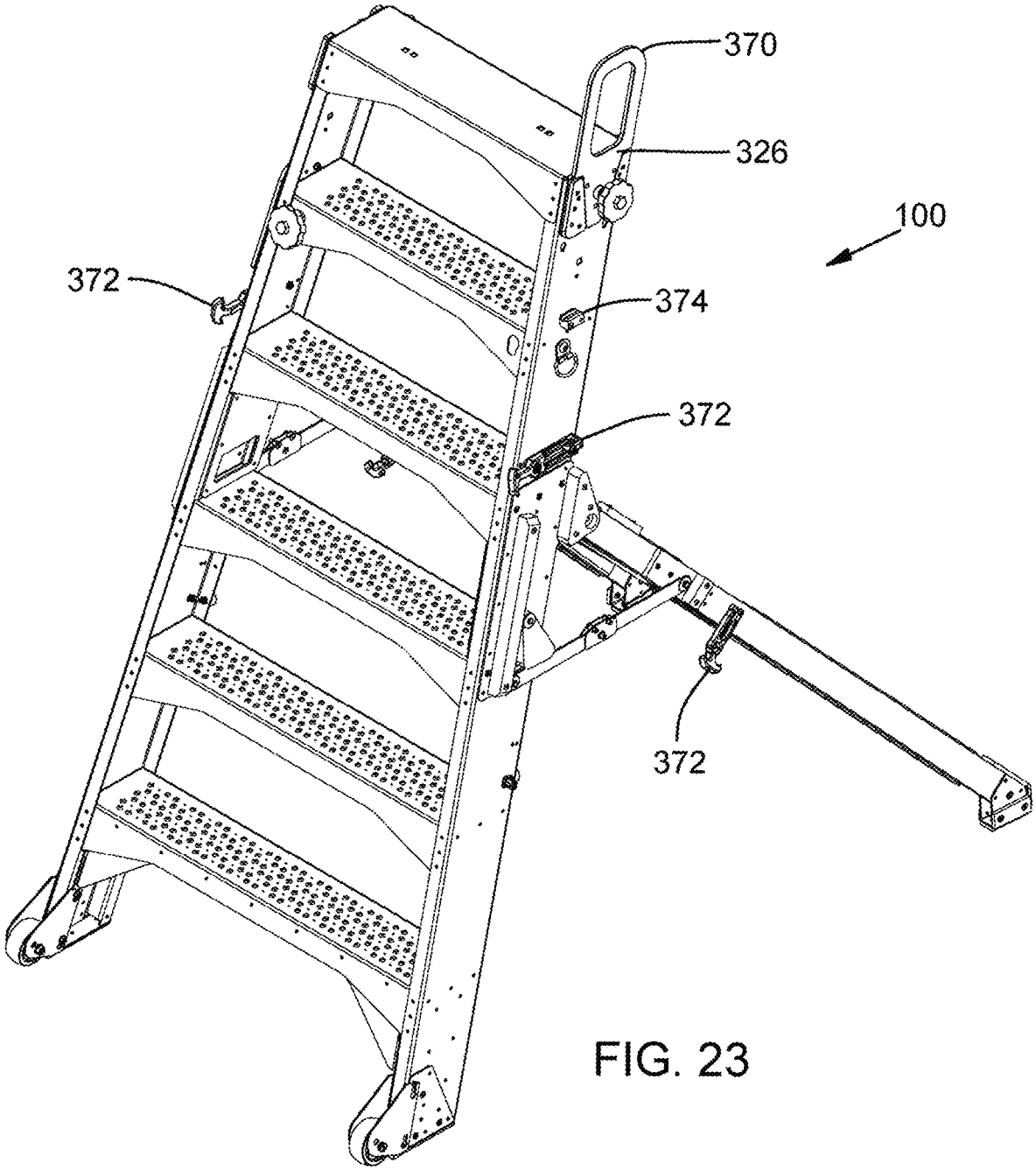
FIG. 23 is a perspective view of the ladder shown in FIG. 22, illustrating the opposite side of the ladder from that shown in FIG. 22.
Figure 24:
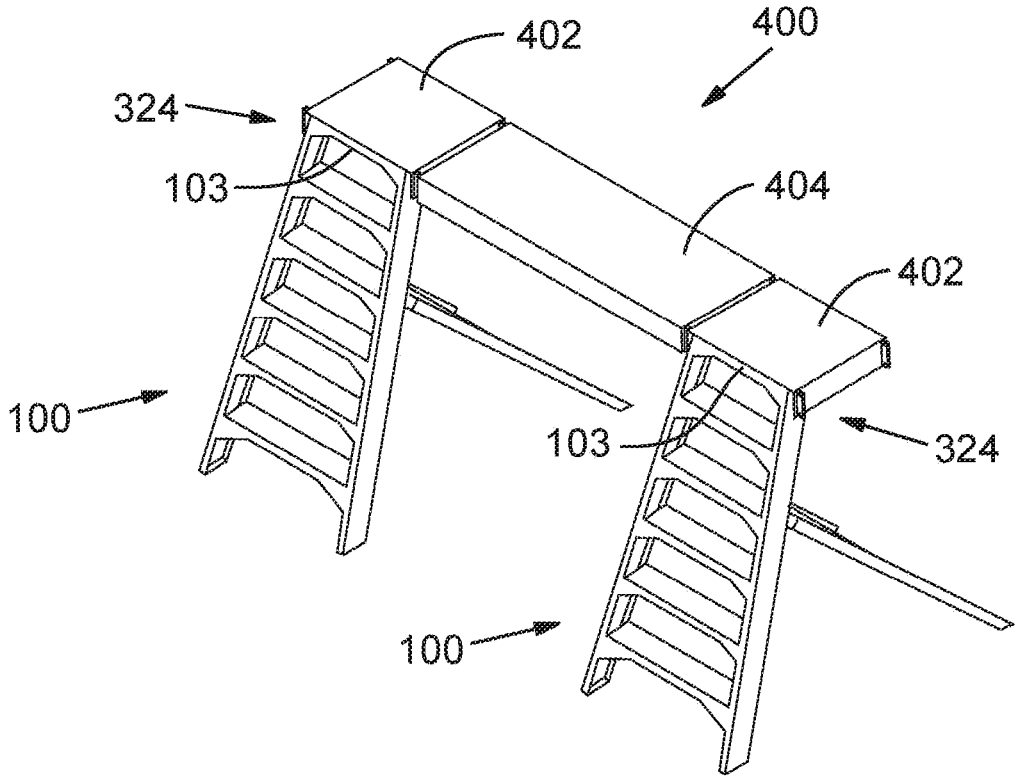
FIG. 24 is a perspective and schematic view of a pair of cantilevered ladders according to the present invention used to support and interconnect a work platform.

Finally, the ladder shown in FIGS. 22 and 23 is yet another embodiment of a ladder 100 that is adapted for attaching an extension module 310. However, the first plate 326 is adapted for use as a handle 370 rather than as a securement mechanism for attaching an extension module to the ladder. More specifically, as best seen in FIG. 23, the lower end of first plate 326 is identical to that described above in respect of FIG. 20, with a downwardly projecting triangular extension 350 that is received in the V-shaped notch 354 in second plate 328. However, the upper part of the first plate 326 is formed into the handle 370. As seen in FIG. 22, the handle 370 that is defined by the first plate 326 may be stored on rail 101 with appropriate mechanisms to secure the handle on the rail for storage, such as a strap 372 and bracket 374.

A ladder according to the present invention may also include, in place of the extension module described above, a standing platform that is attached to the top plate of the ladder in the same manner as the extension module, and which would include hand rails that extend appropriately to the standing platform. Additionally, two ladders according to the invention described herein can be located spaced apart from one another, in either parallel or perpendicular relative orientations, and a scaffolding-like work platform may be used to interconnect the two ladders. Reference is made to FIGS. 24, 25, 26, 27 and 28 in which two ladders 100 of the type described herein are used to support a work platform or scaffolding system 400. Shown generally in FIG. 24, the two outer ends of the work platform 400 are defined by primary platforms 402 that directly attach to the top plate 103 of the ladders, and which include appropriate components of the coupling mechanism 324 to interconnect the primary platforms to the ladders. A work platform 404 interconnects the two primary platforms 402 with appropriate coupling mechanisms to define a complete, stabile scaffolding structure. Additional bracing may be added extending from the platform 400 to the ladders if desired for added strength, and hand rails may be added to the platform as necessary for safety considerations.

Figure 25:
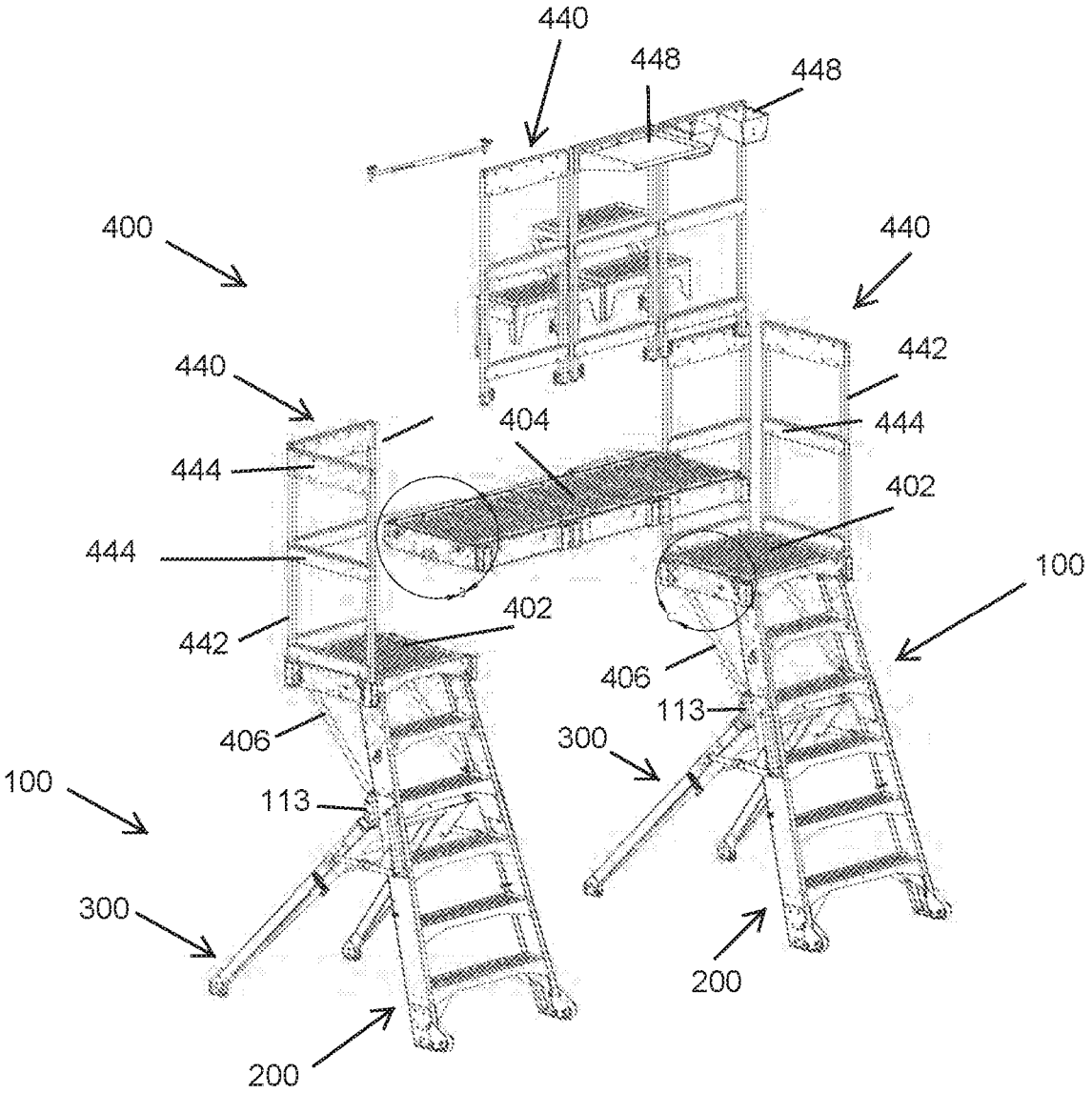
FIG. 25 is a perspective and exploded view of a pair of cantilevered ladders according to the present invention illustrated with a work platform that defines a scaffolding system, in which the two ladders are oriented relative to one another such that they are facing the same direction.
Figure 26:
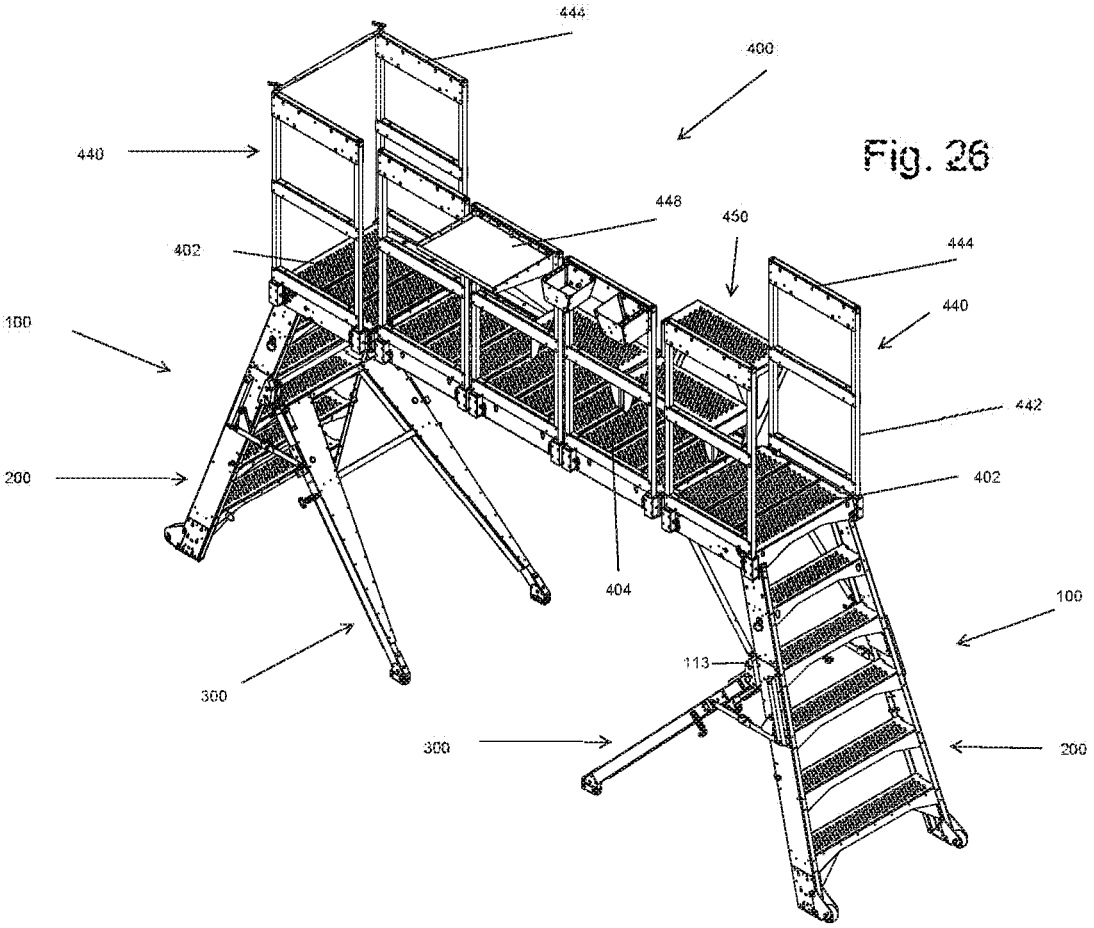
FIG. 26 is a perspective view of another embodiment of a pair of cantilevered ladders according to the present invention illustrated with a work platform that defines a scaffolding system, and in which the two ladders are oriented to face one another.
Figure 27:
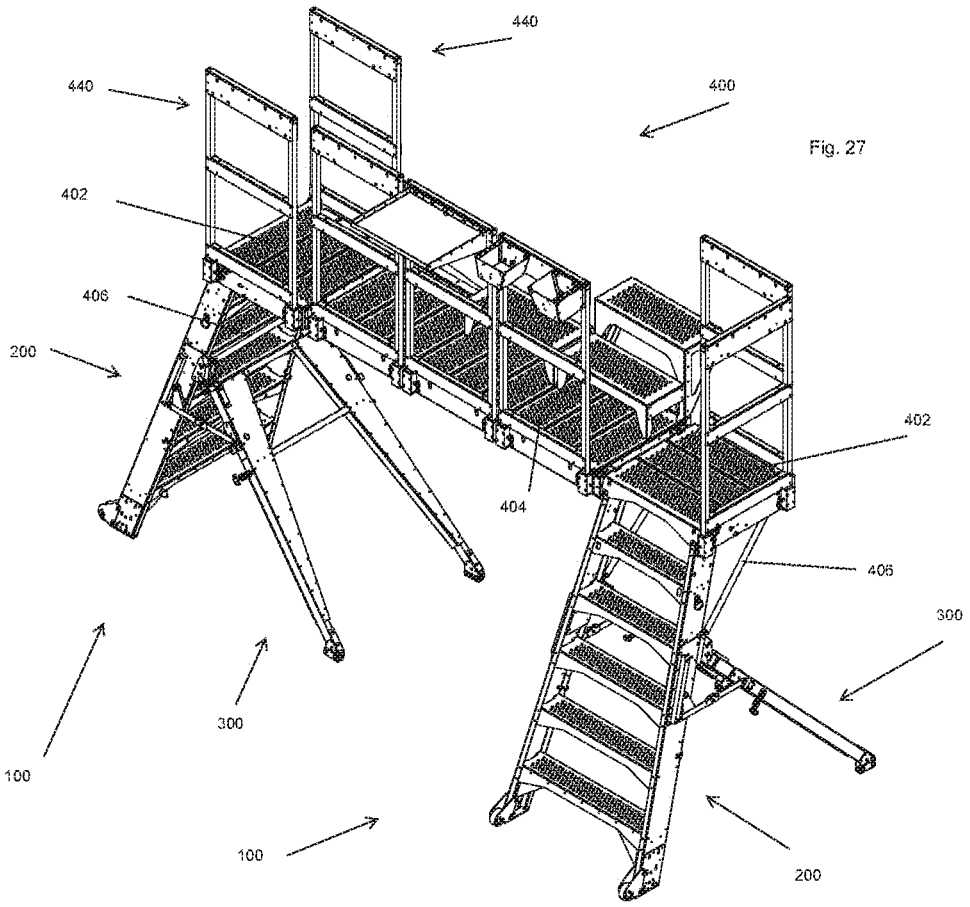
FIG. 27 is a perspective view of yet another embodiment of a pair of cantilevered ladders according to the present invention illustrated with a work platform that defines a scaffolding system, and in which the two ladders are oriented such that one ladder is rotated by 90 degrees relative to the other ladder.

Turning to FIGS. 25, 26 and 27, the scaffolding system 400 is shown in greater detail. The two ladders 100 are cantilevered ladders of the type described above according to the invention. The ladders 100 may be oriented relative to one another in different positions. For example, in FIG. 25 the ladder 100 on the left and the ladder 100 on the right are in the same positions relative to one another so that both are facing the same direction. In FIG. 26 the two ladders 100 have been positioned such that the support units 300 of each ladder are facing one another—that is, both ladders have been rotated 90 degrees toward one another relative to the positions shown in FIG. 25. And in FIG. 27 one ladder 100 (the one on the right in the illustration) has been rotated 90 degrees from its position in FIG. 26 so that, relative to the ladder 100 on the left, the two ladders are oriented at right angles relative to one another. As detailed below, the modularity of the components of scaffolding system 400 allow the varying ladder orientations shown in FIGS. 25, 26 and 27 in order to accommodate using the system in varying on-the-ground situations. For purposes of clarity, when a ladder is said to be "facing" in any given direction the facing direction is the direction from the stepped unit 200 toward the support unit 300. Using this naming convention, the two ladders in FIG. 25 are facing in the same direction; the two ladders in FIG. 26 are facing one another; and the two ladders in FIG. 27 are facing in directions that are 90 degrees different.

The scaffolding system 400 according to the invention comprises a pair of ladders 100, a pair of primary platforms 402, one attached to the top step of each ladder 100, and a work platform 404 that interconnects the two primary platforms 402. Together, the two primary platforms and the work platform define a stable work space on which workers can move about. The primary platforms 402 are connected to the ladders 100 with interface connectors 324 of the type described above with respect to FIGS. 10 and 20, and as shown in FIG. 28A. Thus, as described previously with respect to FIGS. 10 through 20, the primary interconnection between a ladder 100 and a primary platform 402 is provided by the interface connectors 324 such as a first plate 326 (see, e.g., FIG. 29) that is securely attached to the lower end 320 of rail 312 of extension unit 310 such that a portion of the first plate 326 extends beyond the end of the rail 312. Likewise, an identical first plate 326 is attached in the same way to the lower end 320 of rail 314. A second plate 328 is securely attached to the upper end of rail 101 adjacent top plate 103—one second plate 328 is attached to each rail 101. In addition, to the primary connections defined by the coupling mechanisms, the primary platforms 402 are supported with a pair of support struts 406 that extend angularly from the outer, lower edges of the primary platforms to the brackets 113 that join the support unit 300 and stepped unit 200. The brackets 113 are modified to accept the lowermost ends of the struts 406. The support struts 406 provide strength to the primary platform and it will be appreciated that the struts may be configured other than that shown to obtain the same strength. As an example, a single strut or a strut with a Y-configuration may be used but in all instances at least one strut is necessary for stability and strength.

Figure 25A:
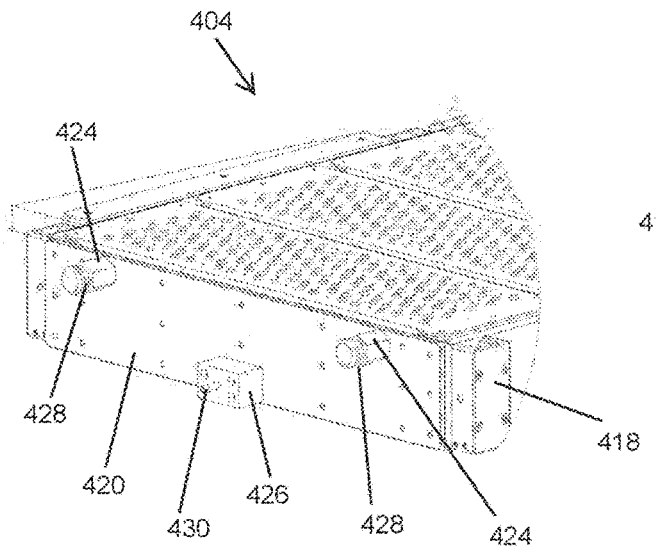
FIG. 25A is a perspective view of one end of the scaffolding work platform shown in the close up circle of FIG. 25.
Figure 25B:
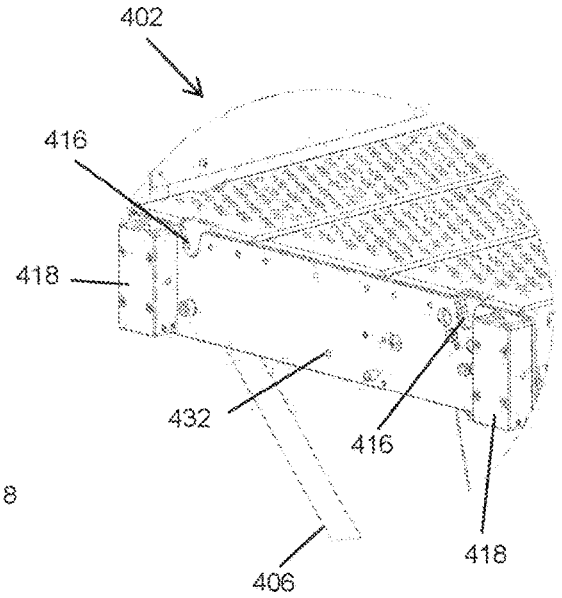
FIG. 25B is a perspective view of one end of the primary platform shown in the close up circle of FIG. 25.
Figure 29:
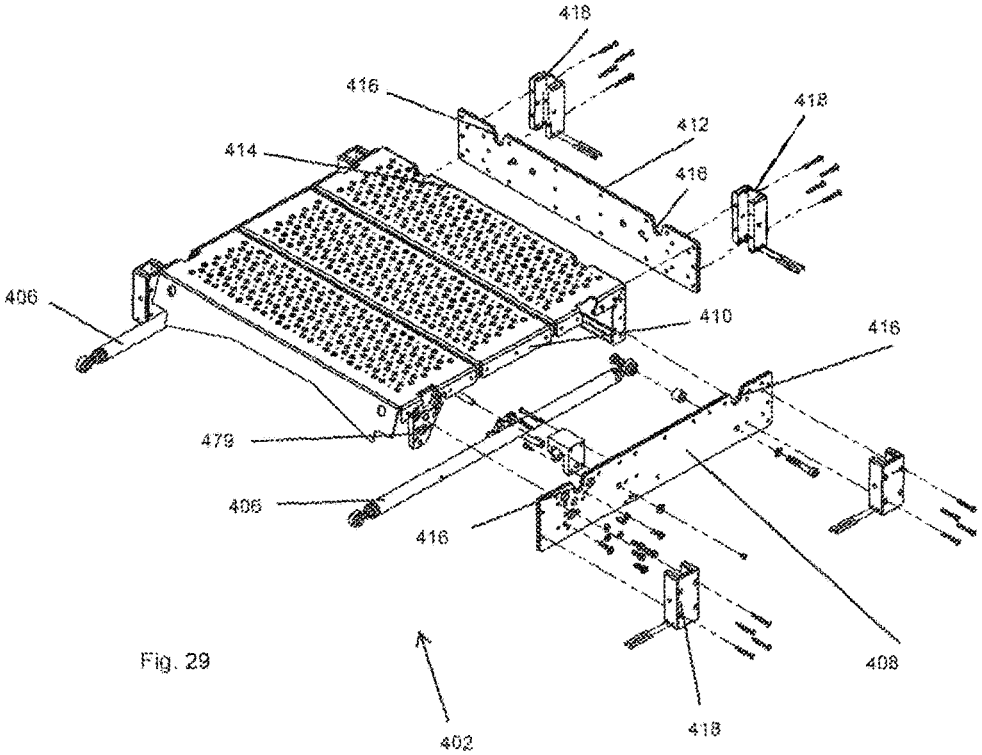
FIG. 29 is a perspective and exploded view of the primary platform that attaches to the top step of the ladder.
Figure 30:
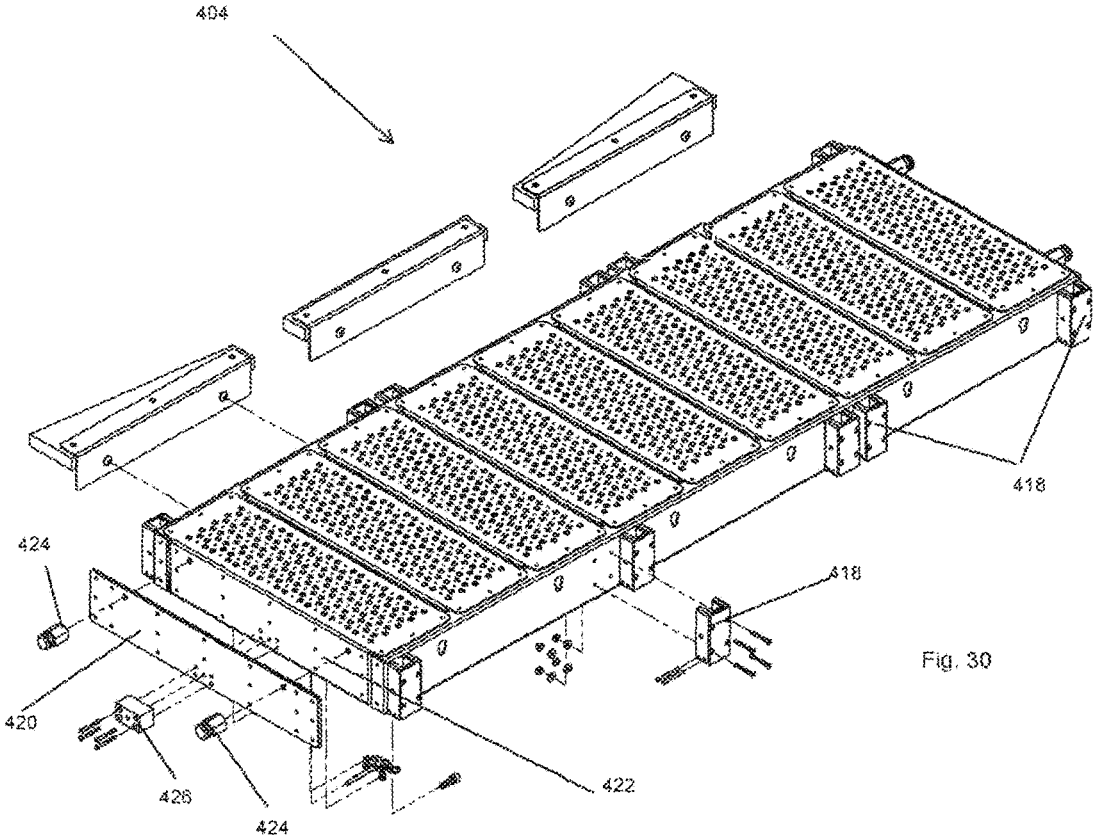
FIG. 30 is a perspective and exploded view of the work platform.

The structures utilized to connect the work platform 404 to the two primary platforms 402 are shown in greater detail in FIGS. 29 and 30, and in the close-up circles of FIGS. 25A and 25B. With reference to FIG. 29, a primary platform 402 is shown with the components exploded. A first plate 408 is attached to lateral side 410 of the platform 402 with appropriate fasteners such as bolts. A second plate 412 is attached to the adjacent side 414 of platform 402. The plates 408 and 412 have two spaced apart notches 416, the purpose of which is detailed below, and plural receptacles 418 are attached to the outer-facing surfaces of the plates. The receptacles 418 are used to receive upright posts that are used for safety rails and the like and are located on three sides of the platform to allow for modularity in the manner that the ladders are oriented relative to one another, and the positions in which safety rails are attached. The work platform 404 is shown in an exploded view in FIG. 30 and it may be seen that an end plate 420 is attached to the outer end 422 of the platform (an identical end plate is attached to the opposite outer end but is not visible in FIG. 30). Two connecting posts 424 and a locating block 426 are attached to plate 420. Each connecting post 424 has a circumferential slot 428, as best shown in FIG. 25A.

Referring now to FIGS. 25A and 25B, the assembled work platform 404 and primary platform 402 are illustrated. With the primary platforms 402 securely attached to two ladders 100 and with the ladders spaced apart from one another by an appropriate distance (and oriented as desired relative to one another) the work platform 404 is connected to the two primary platforms 402 by inserting the connecting posts 424 on work platform 404 into the notches 416 on the primary platforms 402 with the notches 416 engaging the circumferential slots 428. The receptacles 418 are captured between the plates 420 and 408 (or 412, depending upon the relative orientation of the two ladders 100) and thus function as both stand offs to ensure the proper spacing between the plates and as stabilizing structures between the connected platforms. The locating block 426 includes a protruding locator pin 430 that is received in a bore 432 formed in plate 408. The manner of connecting the primary platforms 402 to the ladders 100, and the work platform 404 between the two primary platforms defines a very strong and stable scaffolding platform. Because in an embodiment the ladders 100 are cantilevered, when the two ladders 100 are oriented as shown in FIG. 25 the scaffolding platform may be oriented very close to, for example, a helicopter as shown in FIG. 2, thus allowing mechanics to easily access components that require servicing.

Figure 31:
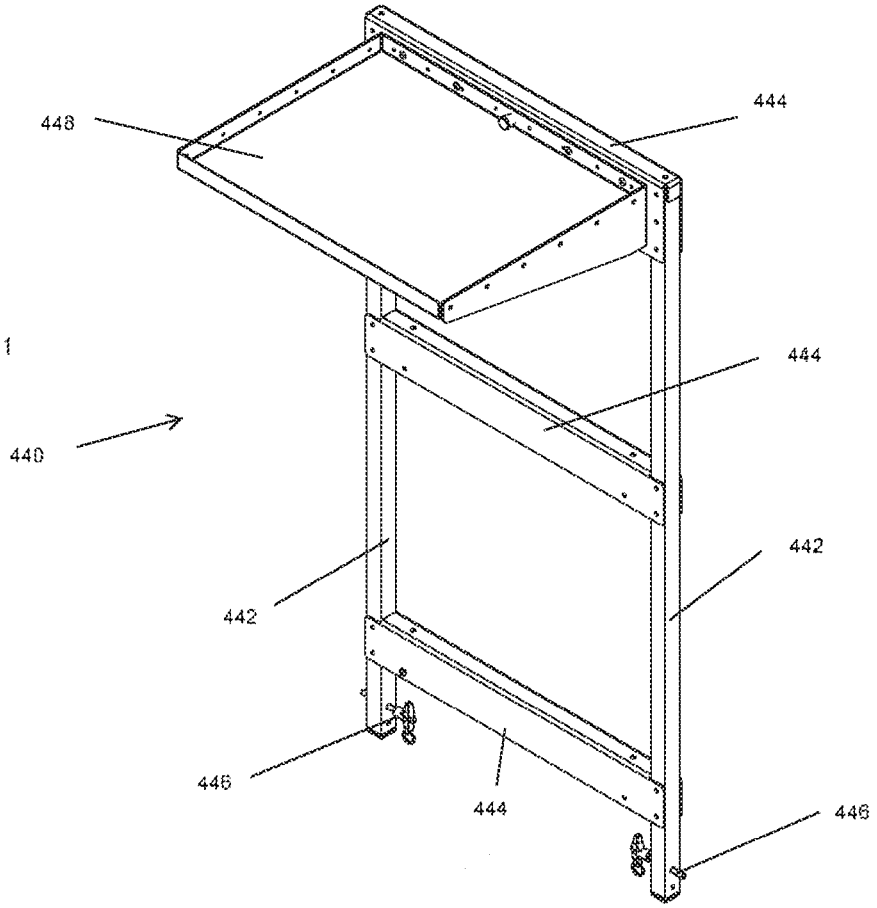
FIG. 31 is a perspective view of a support tray for use with the scaffolding system according to the present invention.
Figure 32:
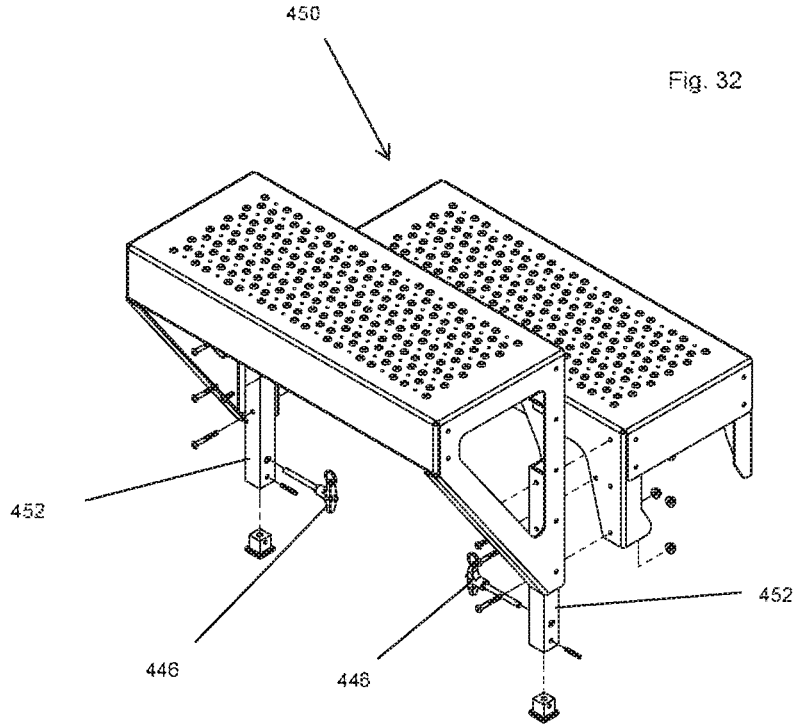
FIG. 32 is a perspective view of steps adapted for use with the scaffolding system according to the present invention.

Since the scaffolding platform just described is elevated above the ground level the scaffolding system 400 includes safety equipment. For example, modular guard rails 440 are defined by upright posts 442 and interconnecting rails 444. The upright posts 442 are spaced apart from one another by the same spacing between adjacent receptacles 418 so that the lower ends of the posts may be inserted stably into the receptacles, and optionally secured in place with, for instance, pins 446 as shown in FIG. 31. Plural receptacles 418 are spaced around the primary platforms 402 and work platform 404 so that the modular guard rails 440 may be located as appropriate for any particular work situation, and according to the orientation of the ladders relative to one another, as illustrated in FIGS. 25, 26, 27 and 28.

Scaffolding system 400 is configured to allow addition of a number of different accessories such as a work trays 448 of different types (FIGS. 25, 31), and modular step ladders 450 such as those shown in FIGS. 25, 26, 27 and 32. Each modular step ladder 450 includes support posts 452 that are spaced apart from one another by the same spacing as adjacent receptacles 418 so that the posts 452 may be inserted into receptacles 418 and secured with pins 446.

Figure 28:
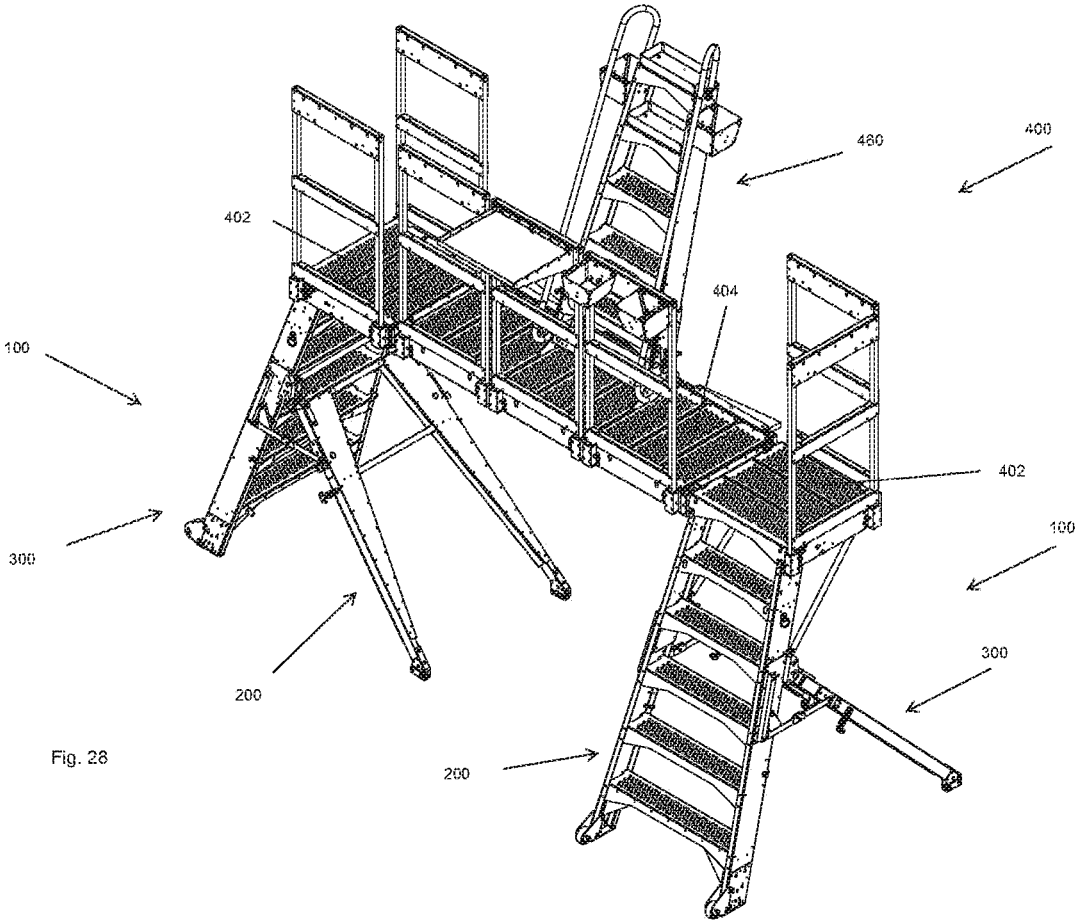
FIG. 28 is a perspective view of the embodiment of a pair of cantilevered ladders shown in FIG. 27, and including a ladder extension attached to the work platform.
Figure 28A:
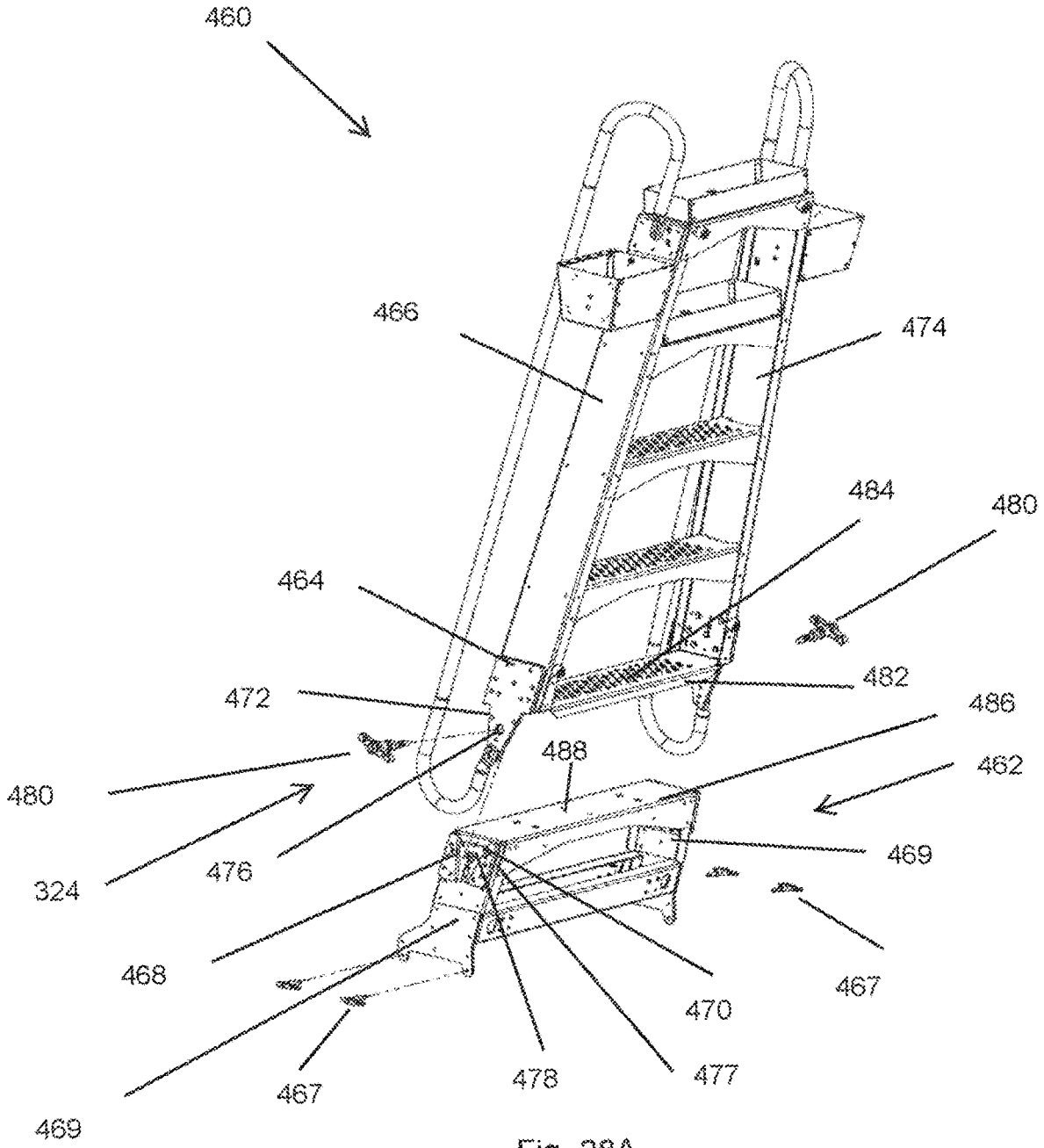
FIG. 28A is an exploded view of the ladder extension illustrated in FIG. 28, showing the ladder extension and its attachment in isolation.

Finally, turning to FIGS. 28 and 28A, a ladder 460 may be connected to work platform 404. The connection between the ladder 460 and platform 404 must be strong enough to support a worker on the ladder and this secure connection is accomplished with an interconnection between the ladder 460 and the platform with a ladder support module 462 that is secured to the platform 404 and which has opposed sides 469 that correspond to and are adapted to form a connection with the opposed side rails 466, 474 of the ladder 460. An interface connector 324 (as described in detail previously with respect to, for example, FIGS. 10 and 20) has a first plate 464 that is securely attached to the lower end of side rail 466 of extension ladder 460. A second plate 468 is securely attached to and is part of the ladder support module 462 at one side 469, which is secured to the platform 404 with appropriate fasteners such as pins 467. Second plate 468 defines a generally V-shaped notch 470 and the first plate 464 defines a V-shaped extension 472 that is cooperatively formed to fit into the notch 470. The opposite rail 474 of ladder 460 includes identical components and it will be appreciated that the interface connector 324 shown in FIG. 28A is identical to that described above in respect of FIG. 20. When ladder 460 is connected to support module 462 the V-shaped extension 472 of plate 464 is received in the cooperatively formed V-shaped notch 470 of second plate 468 of support module 462. At this point a bore 476 in the V-shaped extension 472 aligns with a threaded bore 478 in a backing plate 477 in the support module 462 and a bolt 480 is threaded through bore 476 and into bore 478 and is tightened to thereby stabilize the ladder 460 relative to the platform 404. When the ladder 460 is attached to the support module 462 as described, a flange 482 extends downwardly from the lowermost step 484 and overlaps with the mating edge 486 of the top plate 488 of the extension module 462 in the manner described above with respect to, for example, FIG. 20. An identical flange (not visible in the view of FIG. 28A) extends downwardly from step 484 on the opposite side of the step from that shown in FIG. 28A—and overlaps with the opposite edge of the top plate 488 when the ladder extension module is coupled to the extension module.

Figure 33:
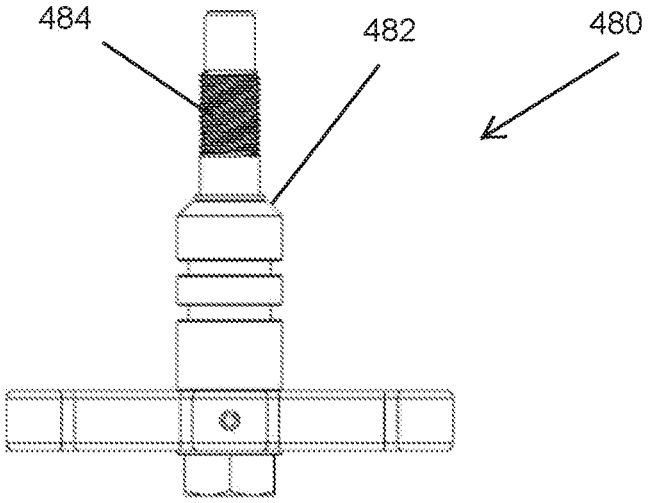
FIG. 33 is an elevation view of a bolt adapted for use with the present invention.

In a preferred embodiment, the dimensions of the V-shaped extension 472 and the mating V-shaped notch 470 are engineered to increase the strength of the connection provided by the interface connector 324. Specifically, the bore 476 in the V-shaped extension and the threaded bore 478 in the backing plate 477 are slightly offset from one another when the V-shaped extension is received in the V-shaped notch so that the bores overlap but the axial centerlines through the respective bores, that is, bore 476 and threaded bore 478, are not coaxial and such that the axial centerline through the bore 476 is slightly above the axial centerline through threaded bore 478. With reference to FIG. 33, the bolt 480 is adapted with a conical shoulder 482 along the length of the bolt. The outer peripheral edge of bore 476 has a conical edge 479 that is configured to mate with the conical shoulder 482 (see, for example, FIG. 29). When bolt 480 is inserted into the mis-aligned bores 476 and 478, the differences in the axial offset is slight enough that the threaded portion 484 of the bolt engages the threads of threaded bore 478. As the bolt is tightened and moves inwardly in the bores, the conical shoulder 482 of the bolt begins to mate with and seat against the conical edge 479 of the bore. As the bolt is further tightened, the V-shaped extension 472 is drawn downwardly as the conical shoulder and conical edge seat fully against one another. This causes substantial compression between the V-shaped extension 472 and the V-shaped notch 470, which significantly increases the strength of the connection.

It will be appreciated that the extension module 310 described herein is not limited to use with folding ladders but instead may be used with a rigid ladder that has the appropriated coupling mechanisms such as those detailed herein to attach the extension module to the ladder.

Reference is now made to the series of drawings of FIGS. 34 through 38, which illustrate a stabilization and anti-rotation system 500 that provides for secure interconnection between the work platform 404 and the primary platforms 402 and prevents relative movement therebetween. The system 500 utilizes the pair of notches 416 that are formed in first plate 408, as described earlier and as illustrate in, for example, FIG. 25B, and the connecting posts 424 that are attached to the second plate 420, as also described earlier and as illustrated in FIG. 25A. However, in the system 500 the locating block 426 and the locator pin 430 of the embodiment of FIG. 25A have been replaced with alternative structures as described below.

Figure 34:
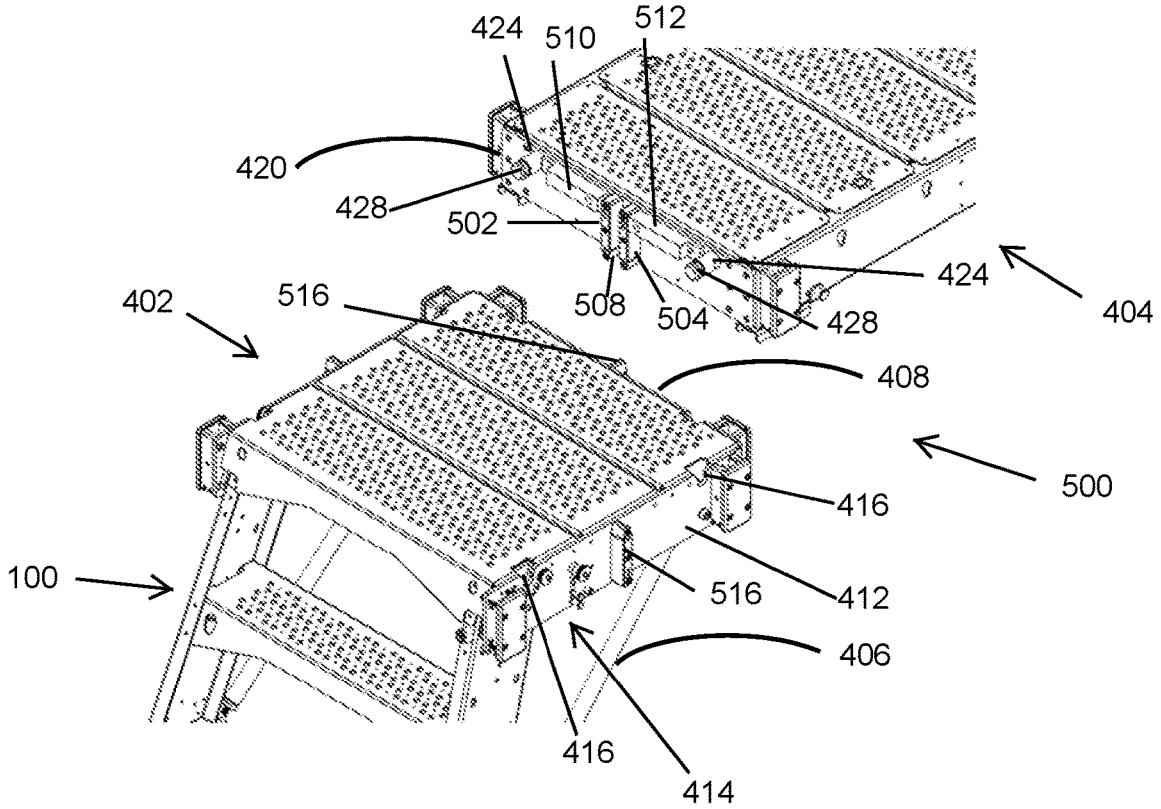
FIGS. 34 through 38 are views of a scaffolding stabilization and anti-rotation apparatus according to the present invention. More specifically.
Figure 35:
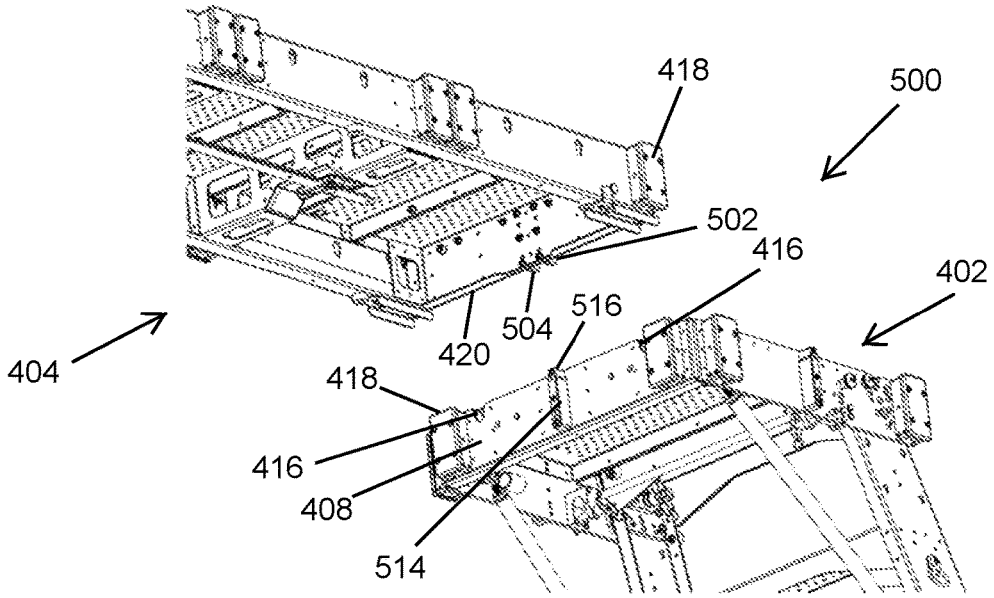
Figure 36:
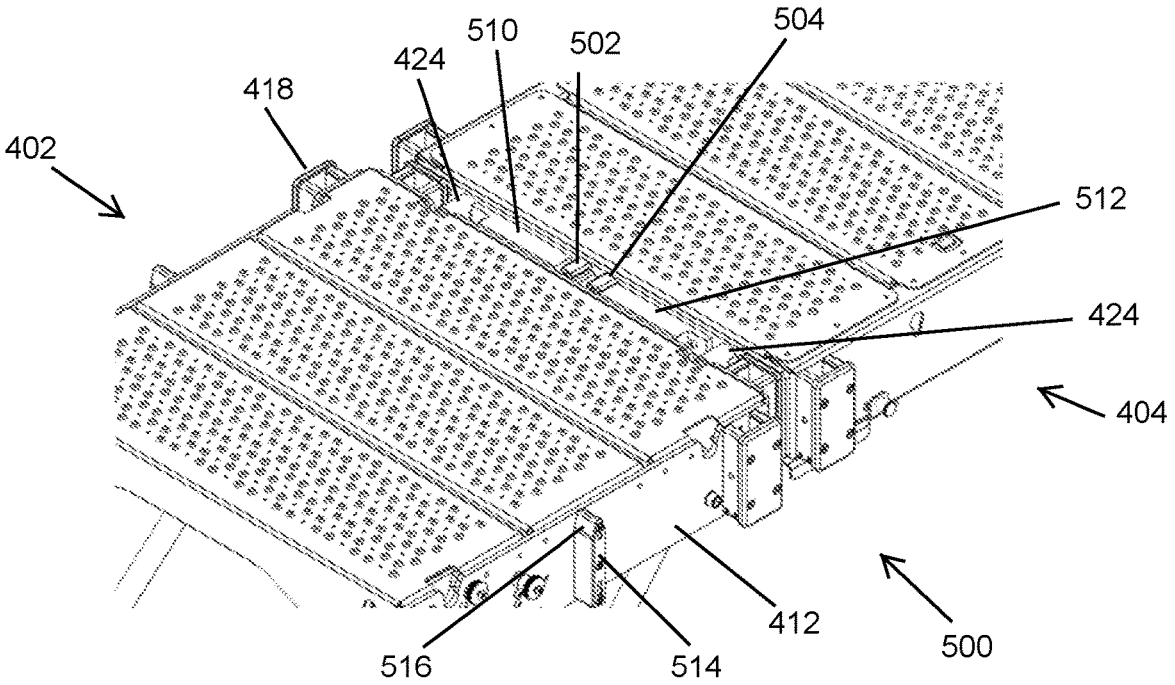
Figure 37:
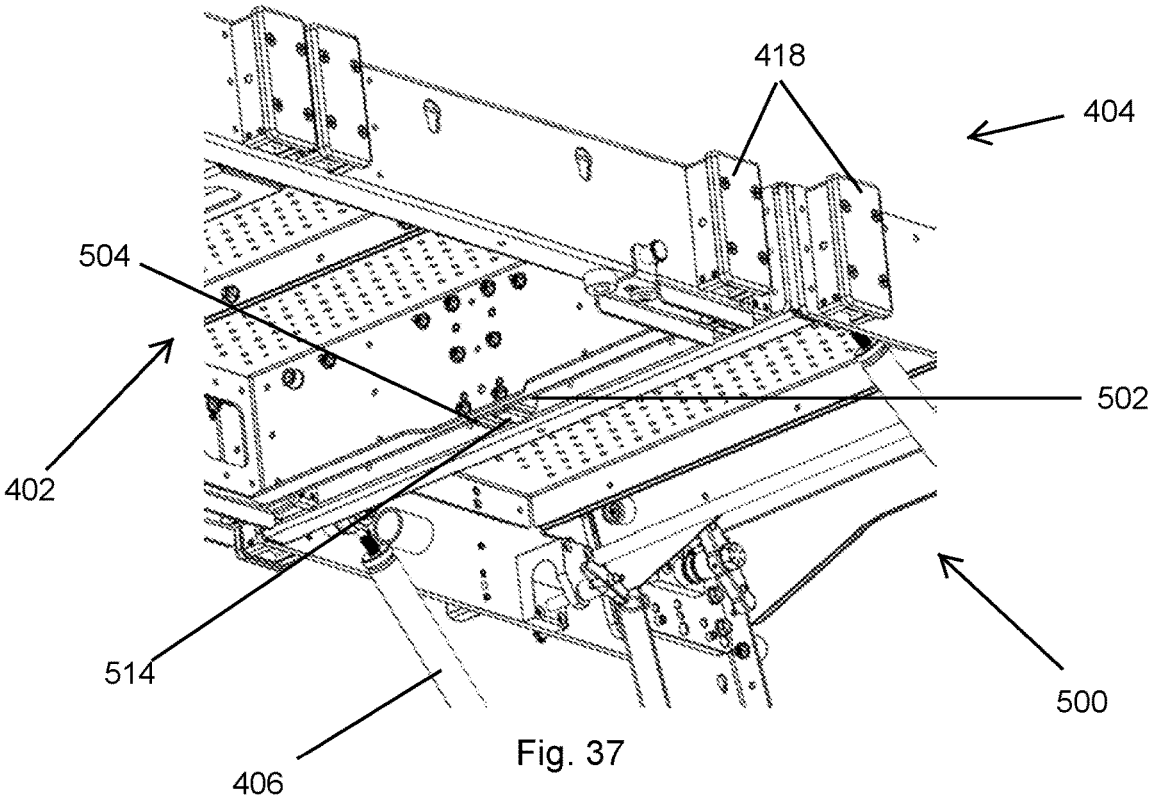

Continuing with respect to FIGS. 34 and 35, and as detailed previously, plate 408 is attached to side 410 of the primary platform 402 with appropriate fasteners such as bolts. A plate 412 is attached to the side 414 of platform 402. The plates 408 and 412 have two spaced apart notches 416, the purpose of which was explained previously, and as further detailed below, and plural receptacles 418 are attached to the outer-facing surfaces of the plates as detailed above. The receptacles 418 are used to receive upright posts that are used for safety rails and the like and are located on three sides of the platform to allow for modularity in the manner that the ladders are oriented relative to one another, and the positions in which safety rails are attached.

The work platform 404 is shown in an exploded view in FIG. 30 and it may be seen that a plate 420 is attached to the outer end 422 of the platform (an identical plate is attached to the opposite outer end but is not visible in FIG. 30). Two connecting posts 424 and a locating block 426 are attached to plate 420. Each connecting post 424 has a circumferential slot 428, as best shown in FIG. 25A.

Figure 38:
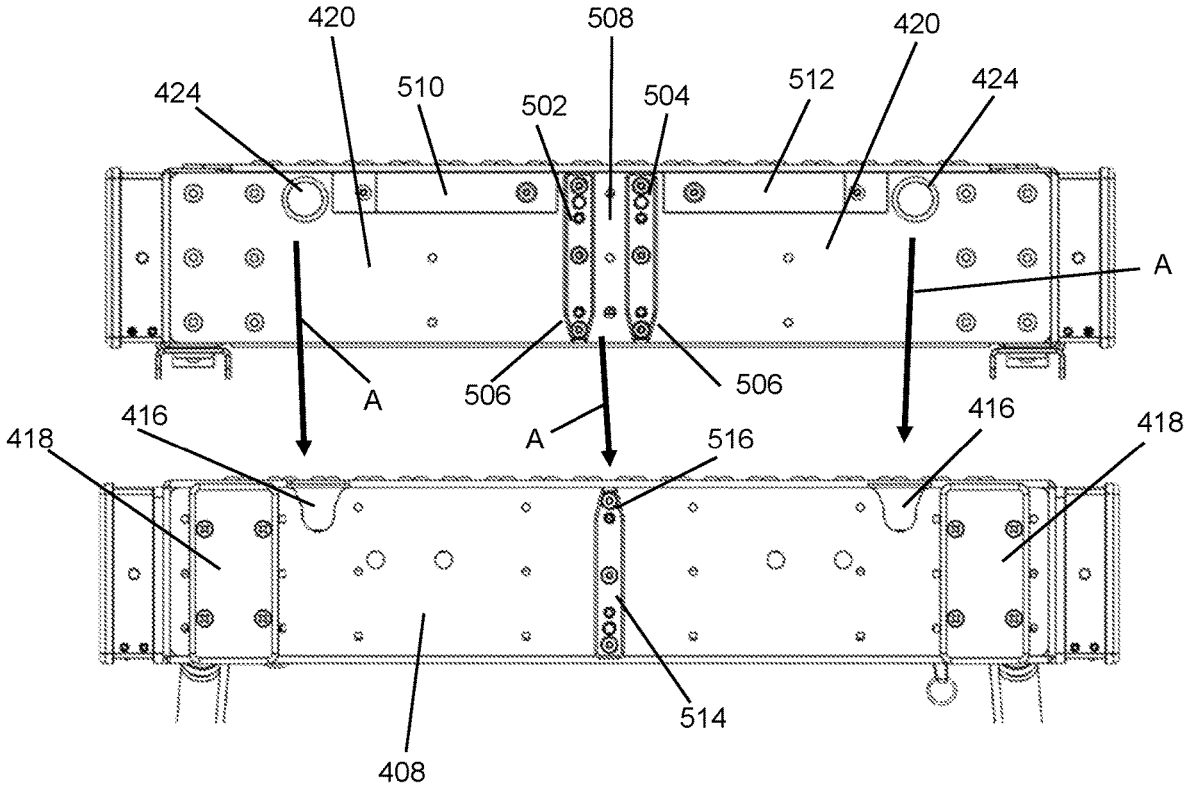

Returning to FIGS. 34 and 35, pair of spaced apart and vertically oriented guide blocks 502 and 504 are attached on plate 420 of work platform 404, preferably with the blocks positioned along the lateral length of the plate so that a spaced apart guide slot 508 is at the center of the plate. The guide blocks 502 and 504 at attached to plate 420 with appropriate fasteners. The lower ends 506 of the guide blocks are tapered, as best illustrated in FIG. 38. Because the guide blocks 502 and 504 are spaced apart, the guide slot 508 is defined between the blocks. A first spacer block 510 is affixed to plate 420 on one lateral side of the plate 420 outwardly of guide block 502, and a second spacer block 512 is affixed to plate 420 on lateral side of the plate 420 outwardly of guide block 504.

As shown in FIG. 35, a single locator, or locating block 514 is attached to plate 410 of primary platform 402 with appropriate fasteners (a similar locating block is attached to the adjacent plates of the primary platforms 402). The upper end 516 of locating block 514 is tapered. The width of locating block 514 is slightly less than the width of guide slot 508 so that the locating block 514 may be slid into the guide slot 508 with very close tolerances between the sides of the block 514 and the facing sides of the blocks 502 and 504.

The structures described above are especially well-illustrated in the elevation views of FIGS. 38 and 39.

The combination of the guide blocks 502 and 504 with locating block 514 function to stabilize the work platform 404 relative to the primary platforms 502 when the work platform is assembled with two primary platforms to detailed above, and prevents rotation of the work platform relative to the primary platforms when, for example, one side of the work platform is loaded with a heavy load.

To assemble a scaffolding system 400 as described earlier using the stabilization and anti-rotation system 500, the assembled work platform 404 and primary platform 402 as shown in FIGS. 34 and 35 are securely attached to two ladders 100 and with the ladders spaced apart from one another by an appropriate distance (and oriented as desired relative to one another). The work platform 404 is connected to the two primary platforms 402 by moving the work platform downwardly relative to the stationary ladders 100 and such that the tapered upper end 516 of the locating block 514 on plate 408 is inserted into the guide slot 508 between the guide blocks 502 and 504 on plate 420. As noted, the width of locating block 514 is preferably very slightly less than the width of guide slot 508. Because the upper end 516 of locating block 514 is tapered, and the lower ends 506 of guide blocks 502 and 504 are tapered, the block 514 slides very easily into the slot 508. The two spacing blocks 510 and 512 on plate 420 abut plate 410 and thus act as stand-offs that ensure that the work platform 404 and the primary platforms 402 are separated by the ideal distance when the scaffolding system 400 is assembled.

FIG. 38 shows one end of the primary platform situated below one end of the work platform to illustrate how the two are interconnected. Of course, in FIG. 38 the illustration of one of either the primary platform or the work platform is 180 degrees rotated from the position that the rotated platform would be when in actual use, but the illustration shows the interconnection well. More specifically, in FIG. 38 the plate 420 of the work platform 404 is shown vertically above the plate 408 of the primary platform 402. As the work platform is moved downwardly toward the primary platform, in the direction of the arrows in FIG. 38, the locating block 514 slides into the slot 508 between the two guide blocks 502 and 504. The connecting posts 424 on work platform 404 slide into the notches 416 on the primary platforms 402 with the notches 416 engaging the circumferential slots 428. The receptacles 418 are captured between the primary platforms and work platform and thus also function as stand offs to ensure the proper spacing between the plates and as stabilizing structures between the connected platforms, and the spacing blocks 510 and 512 also act as stand offs to ensure spacing.

The manner of connecting the primary platforms 402 to the ladders 100, and the work platform 404 between the two primary platforms defines a very strong and stable scaffolding platform. Because the locating block 514 is located in guide slot 508 between blocks 502 and 504 with minimal tolerance between the blocks, the work platform 404 is prevented from axial rotation relative to the primary platforms 402. As an example, with reference to the scaffolding system 400 as shown in FIG. 26, which includes a ladder 460 attached to one side of the work platform 404, the ladder 460 can place a large load along the edge of the work platform that tends to put an axial rotational load on the work platform (axial being along the longitudinal axis of the work platform). The stabilization and anti-rotation system 500 as described and shown in the drawings prevents relative rotation of the work platform relative to the primary platforms and thus increases safety.

It will be appreciated that the ladders 100 that are used as part of a scaffolding system 400 that utilizes the stabilization and anti-rotation system 500 may be oriented relative to one another in any of the orientations described above. It will further be understood that the relative positions of the stabilization components described above may be reversed. For example, the guide blocks 502 and 504 may be located on plate 408 with the locating block 514 located on plate 420.

It is believed that the present invention as described and its many attendant advantages will be understood by the foregoing description. It is also believed that it will be apparent that various changes may be made in the form, construction and arrangements of the components thereof without departing from the scope and spirit of the invention and without sacrificing all of its material advantages. Thus, the breadth and scope of the present invention should not be limited by any of the above-described exemplary embodiments, but should instead be defined only in accordance with the following claims and their equivalents.

The invention claimed is:

1. Apparatus for stabilizing a work platform extending between first and second ladders, comprising:

a first platform attached to a first ladder, the first platform having a first side plate having first and second notches formed therein, each of the notches being vertically oriented and having an open upper end and a closed lower end, and a locating block attached to the first side plate;

a second platform attached to a second ladder, the second platform having a second side plate having first and second notches formed therein, each of the notches being vertically oriented and having an open upper end and a closed lower end, and a locating block attached to the second side plate;

a work platform having opposed first and second end plates, each of the first and second end plates of the work platform having first and second connecting posts extending therefrom, wherein each of the first and second end plates of the work platform further have a pair of spaced apart guide blocks defining a guide slot therebetween adapted to receive a corresponding one of the locating blocks;

wherein the work platform is adapted to be connected to the first and second platforms with the respective first and second end plates of the work platform facing the respective first side plate of the first platform and second side plate of the second platform, the locating blocks configured for sliding downwardly into the guide slots, and ends of the respective first and second connecting posts of the first and second end plates of the work platform sliding downwardly into the respective first and second notches of the first and second plates of the first and second platforms such that the ends of the connecting posts are supported by the closed lower ends of the notches and can be removed therefrom by lifting the work platform and sliding the ends of the connecting posts upward through the open upper ends;

wherein each locating block is received in the corresponding guide slot with sufficiently close tolerance to prevent axial rotation of the work platform relative to the first and second platforms.

2. The apparatus according to claim 1 wherein the first and second ladders are folding ladders.

3. The apparatus according to claim 2 wherein the first and second ladders are cantilevered ladders.

4. The apparatus according to claim 1 in which each locating block is defined by a vertically oriented member having a width and the guide slot is a vertically oriented, and wherein the slot has a width that is greater than the width of the vertically oriented member.

5. The apparatus according to claim 4 in which each vertically oriented member has an upper end that is tapered.

6. The apparatus according to claim 4 in which each of the guide blocks has a lower end that is tapered.

7. The apparatus according to claim 1 in which the first ladder is positioned relative to the second ladder such that both ladders are facing the same direction.

8. The apparatus according to claim 1 in which the first ladder is positioned relative to the second ladder such that the second ladder is rotated by 90 degrees relative to the first ladder.

9. The apparatus according to claim 1 in which the second ladder is rotated by 180 degrees relative to the first ladder.

10. The apparatus according to claim 1 further including at least two spacers on each of the first and second end plates of the work platform.

11. The apparatus according to claim 1 in which the first and second platforms further include receptacles for receiving upright posts.

12. Apparatus for stabilizing a work platform extending between first and secondladders, comprising:

a first cantilevered ladder defined by first and second stepped unit side rails, a top plate interconnecting the first and second stepped unit side rails at an upper end thereof, a support unit defined by first and second support unit side rails, and a primary platform attached to the first and second stepped unit side rails and extending over the top plate;

a second cantilevered ladder defined by first and second stepped unit side rails each having bottom ends, plural steps interconnecting the first and second stepped unit side rails, a top plate interconnecting the first and second stepped unit side rails at an upper end thereof, a support unit defined by first and second support unit side rails, and a primary platform attached to the first and second stepped unit side rails and extending over the top plate;

a scaffolding platform having a first end interconnected to the primary platform of the first cantilevered ladder and a second end interconnected to the primary platform of the second cantilevered ladder, the first and second ends of the scaffolding platform being interconnected to the primary platforms in a manner that allows removal of the scaffolding platform from the primary platforms simply by lifting the scaffolding platform vertically to slide male connectors upwardly out of vertically oriented receiving notches;

a first anti-rotation assembly associated with the interconnection between the first end of the scaffolding platform and the primary platform of the first cantilevered ladder and a second anti-rotation assembly associated with the interconnection between the second end of the scaffolding platform and the primary platform of the second cantilevered ladder;

the first and second anti-rotation assemblies each comprising a locating member attached to a selected one of either a primary platform or an end of the scaffolding platform, the locating member defined by a vertically oriented member with a tapered upper end; and a locator receiver attached to the primary platform or the end of the scaffolding platform to which the locating member is not attached, the locator receiver comprising a pair of spaced apart members defining a vertically oriented guide slot therebetween into which the locating member is received by a vertical sliding motion;

wherein each locating member is received in the corresponding locator receiver with sufficiently close tolerance to prevent axial rotation of the scaffolding platform relative to the primary platforms.

13. The apparatus according to claim 12 wherein the first and second cantilevered ladders are folding ladders.

* * * * *